US006322445B1

(12) United States Patent
Miller

(10) Patent No.: US 6,322,445 B1
(45) Date of Patent: Nov. 27, 2001

(54) MULTI-LINE POKER VIDEO GAMING APPARATUS AND METHOD

(75) Inventor: Gary Miller, Las Vegas, NV (US)

(73) Assignee: Innovative Gaming Corporation of America, Reno, NV (US)

( * ) Notice: Subject to any disclaimer, the term of this patent is extended or adjusted under 35 U.S.C. 154(b) by 0 days.

(21) Appl. No.: 09/366,088

(22) Filed: Aug. 3, 1999

(51) Int. Cl.[7] ..... A63F 9/24
(52) U.S. Cl. ..... 463/13; 463/12; 273/293
(58) Field of Search ..... 463/12, 13, 16, 463/20; 273/292, 293, 303

(56) References Cited

U.S. PATENT DOCUMENTS 5,807,172 * 9/1998 Piechowiak ..... 463/20
5,823,873 10/1998 Moody .
5,971,849 * 10/1999 Falciglia ..... 463/16
6,007,066 * 12/1999 Moody ..... 273/292

* cited by examiner

*Primary Examiner*—Valencia Martin-Wallace
*Assistant Examiner*—Julie Kasick

(74) *Attorney, Agent, or Firm*—Merchant & Gould P.C.

(57) ABSTRACT

A method of playing a multi-line poker game of cards on a computer-based video gaming device is disclosed. The poker game has a game hand line and a plurality of bonus lines that are combined to create a game array. The game array itself has a plurality of paylines used in determining winnings for the play of the game. The method of playing the multi-line poker comprises determining a set of game parameters from a set of input signals from a player. Next a plurality of cards are randomly dealt from a deck of cards to fill the game hand line. The player selects cards from the within the game hand that are to be held and the cards that are to be discarded. Cards from the deck of cards are randomly dealt to replace all of the cards discarded from within the game hand. Each card now within the game hand is duplicated and randomly placed within the plurality of bonus lines until all of the locations within the game array are filled with cards. Winning combinations of poker hands are determined for the paylines contained in the game array. An award amount is determined for all winning combinations found within paylines based upon the winning combination, the identity of the payline, and the amount of any wager placed on the payline containing the winning combination.

10 Claims, 46 Drawing Sheets

INSERT COIN
MAX BET PLACED ON ALL PAYLINES

DEAL CARDS

HOLD CARDS

DRAW CARDS
BONUS LINES DISPLAY CARDS

DRAW COMPLETED

PAYLINE 1 / GAME HAND
PAIR OF ACES

PAYLINE 2
FULL HOUSE

GAME OVER
PAYLINE 3
PAIR OF QUEENS

OPTIONAL PAYLINE CONFIGURATIONS

LINES CAN BE SUBSTITUTED FOR EXISTING LINE OR ADDED TO INCREASE LINES PER GAME

OPTIONAL PAYLINE CONFIGURATIONS

LINES CAN BE SUBSTITUTED FOR EXISTING LINES OR ADDED TO INCREASE LINES PER GAME

FIG. 3e

INSERT COIN
MAX BET PLACED ON ALL PAYLINES

| | | | | |
|---|---|---|---|---|
| | | | | |
| | | | | |
| | | | | |
| | | | | |
| | | | | |

DEAL CARDS

| | | | | |
|---|---|---|---|---|
| | | | | |
| | | | | |
| | | | | |
| | | | | |
| A | 4 | 7 | K | 3 |

HOLD CARDS

| | | | | |
|---|---|---|---|---|
| | | | | |
| | | | | |
| | | | | |
| | | | | |
| A | | | | |

DRAW CARDS
BONUS LINES DISPLAY CARDS

| | | | | |
|---|---|---|---|---|
| J | A | | | 9 |
| | 9 | | A | J |
| 9 | | | A | J |
| 9 | A | J | | |
| A | J | 9 | | |

DRAW COMPLETED

| | | | | |
|---|---|---|---|---|
| J | A | Q | A | 9 |
| A | 9 | Q | A | J |
| 9 | Q | A | A | J |
| 9 | A | J | A | Q |
| A | J | 9 | A | Q |

PAYLINE 1 / GAME HAND
PAIR OF ACES

| | | | | |
|---|---|---|---|---|
| | | | | |
| | | | | |
| | | | | |
| | | | | |
| A | J | 9 | A | Q |

PAYLINE 2
3 OF KIND

| | | | | |
|---|---|---|---|---|
| J | | | | |
| A | | | | |
| 9 | | | | |
| 9 | | | | |
| 9 | | | | |

PAYLINE 3
TWO PAIR

| | | | | |
|---|---|---|---|---|
| | A | | | |
| | 9 | | | |
| | Q | | | |
| | A | | | |
| | Q | | | |

PAYLINE 4
PAIR OF QUEENS

| | | | | |
|---|---|---|---|---|
| | | Q | | |
| | | Q | | |
| | | A | | |
| | | J | | |
| | | 9 | | |

PAYLINE 5
5 OF A KIND ACES

| | | | | |
|---|---|---|---|---|
| | | | A | |
| | | | A | |
| | | | A | |
| | | | A | |
| | | | A | |

PAYLINE 6
TWO PAIR

| | | | | |
|---|---|---|---|---|
| | | | | 9 |
| | | | | J |
| | | | | J |
| | | | | Q |
| | | | | Q |

PAYLINE 7
FOUR OF KIND

| | | | | |
|---|---|---|---|---|
| | | | | 9 |
| | | | A | |
| | | A | | |
| | A | | | |
| A | | | | |

PAYLINE 8
PAIR OF ACES

| | | | | |
|---|---|---|---|---|
| J | | | | |
| | 9 | | | |
| | | A | | |
| | | | A | |
| | | | | Q |

GAME OVER

| | | | | |
|---|---|---|---|---|
| J | A | Q | A | 9 |
| A | 9 | Q | A | J |
| 9 | Q | A | A | J |
| 9 | A | J | A | Q |
| A | J | 9 | A | Q |

| | | | | |
|---|---|---|---|---|
| | | | | |
| | | | | |
| | | | | |
| | | | | |
| | | | | |

| | | | | |
|---|---|---|---|---|
| | | | | |
| | | | | |
| | | | | |
| | | | | |
| | | | | |

FIG. 3f

INSERT COIN
MAX BET PLACED ON ALL PAYLINES

DEAL CARDS

| | | | | |
|---|---|---|---|---|
| | | | | |
| | | | | |
| A | 4 | 7 | K | 3 |
| | | | | |
| | | | | |

HOLD CARDS

| | | | | |
|---|---|---|---|---|
| | | | | |
| | | | | |
| A | | | | |
| | | | | |
| | | | | |

DRAW CARDS
BONUS LINES DISPLAY CARDS

| | | | | |
|---|---|---|---|---|
| J | A | | | 9 |
| | 9 | | A | J |
| A | J | 9 | | |
| 9 | A | J | | |
| 9 | | | A | J |

DRAW COMPLETED

| | | | | |
|---|---|---|---|---|
| J | A | Q | A | 9 |
| A | 9 | Q | A | J |
| A | J | 9 | A | Q |
| 9 | A | J | A | Q |
| 9 | Q | A | A | J |

PAYLINE 1 / GAME HAND
PAIR OF ACES

| | | | | |
|---|---|---|---|---|
| | | | | |
| | | | | |
| A | J | 9 | A | Q |
| | | | | |
| | | | | |

PAYLINE 2
TWO PAIR

| | | | | |
|---|---|---|---|---|
| J | | | | |
| A | | | | |
| A | | | | |
| 9 | | | | |
| 9 | | | | |

PAYLINE 3
PAIR OF ACES

| | | | | |
|---|---|---|---|---|
| | A | | | |
| | 9 | | | |
| | J | | | |
| | A | | | |
| | Q | | | |

PAYLINE 4
PAIR OF QUEENS

| | | | | |
|---|---|---|---|---|
| | | Q | | |
| | | Q | | |
| | | 9 | | |
| | | J | | |
| | | A | | |

PAYLINE 5
5 OF A KIND ACES

| | | | | |
|---|---|---|---|---|
| | | | A | |
| | | | A | |
| | | | A | |
| | | | A | |
| | | | A | |

PAYLINE 6
TWO PAIR

| | | | | |
|---|---|---|---|---|
| | | | | 9 |
| | | | | J |
| | | | | Q |
| | | | | Q |
| | | | | J |

PAYLINE 7
FULL HOUSE

| | | | | |
|---|---|---|---|---|
| | | | | 9 |
| | | | A | |
| | | 9 | | |
| | A | | | |
| 9 | | | | |

PAYLINE 8
TWO PAIR

| | | | | |
|---|---|---|---|---|
| J | | | | |
| | 9 | | | |
| | | 9 | | |
| | | | A | |
| | | | | J |

GAME OVER

| | | | | |
|---|---|---|---|---|
| J | A | Q | A | 9 |
| A | 9 | Q | A | J |
| A | J | 9 | A | Q |
| 9 | A | J | A | Q |
| 9 | Q | A | A | J |

| | | | | |
|---|---|---|---|---|
| | | | | |
| | | | | |
| | | | | |
| | | | | |
| | | | | |

| | | | | |
|---|---|---|---|---|
| | | | | |
| | | | | |
| | | | | |
| | | | | |
| | | | | |

FIG. 3g

INSERT COIN
MAX BET PLACED ON ALL PAYLINES

| | | | | |
|---|---|---|---|---|
| | | | | |
| | | | | |
| | | | | |
| | | | | |
| | | | | |

DEAL CARDS

| | | | | |
|---|---|---|---|---|
| | | | | |
| | | | | |
| | | | | |
| | | | | |
| A | 4 | 7 | K | 3 |

HOLD CARDS

| | | | | |
|---|---|---|---|---|
| | | | | |
| | | | | |
| | | | | |
| | | | | |
| A | | | | |

DRAW CARDS
BONUS LINES DISPLAY CARDS

| | | | | |
|---|---|---|---|---|
| J | A | | | 9 |
| | 9 | | A | J |
| 9 | | | A | J |
| 9 | A | J | | |
| A | J | 9 | | |

DRAW COMPLETED

| | | | | |
|---|---|---|---|---|
| J | A | Q | A | 9 |
| A | 9 | Q | A | J |
| 9 | Q | A | A | J |
| 9 | A | J | A | Q |
| A | J | 9 | A | Q |

PAYLINE 1 / GAME HAND
PAIR OF ACES

| | | | | |
|---|---|---|---|---|
| | | | | |
| | | | | |
| | | | | |
| | | | | |
| A | J | 9 | A | Q |

PAYLINE 2
TWO PAIR

| | | | | |
|---|---|---|---|---|
| J | | | | |
| A | | | | |
| 9 | | | | |
| 9 | | | | |
| A | | | | |

PAYLINE 3
PAIR OF ACES

| | | | | |
|---|---|---|---|---|
| | A | | | |
| | 9 | | | |
| | Q | | | |
| | A | | | |
| | J | | | |

PAYLINE 4
PAIR OF ACES

| | | | | |
|---|---|---|---|---|
| | | Q | | |
| | | Q | | |
| | | A | | |
| | | J | | |
| | | 9 | | |

PAYLINE 5
FIVE OF A KIND ACES

| | | | | |
|---|---|---|---|---|
| | | | A | |
| | | | A | |
| | | | A | |
| | | | A | |
| | | | A | |

PAYLINE 6
TWO PAIR

| | | | | |
|---|---|---|---|---|
| | | | | 9 |
| | | | | J |
| | | | | J |
| | | | | Q |
| | | | | Q |

PAYLINE 7
4 OF A KIND ACES

| | | | | |
|---|---|---|---|---|
| | | | | 9 |
| | | | A | |
| | | A | | |
| | A | | | |
| A | | | | |

PAYLINE 8
NO WIN

| | | | | |
|---|---|---|---|---|
| J | | | | |
| | 9 | | | |
| | | 9 | | |
| | | | A | |
| | | | | Q |

PAYLINE 9
NO WIN

| | | | | |
|---|---|---|---|---|
| J | | | | 9 |
| | | | | |
| | | 9 | | |
| | | | | |
| A | | | | Q |

PAYLINE 10
3 OF A KIND

| | | | | |
|---|---|---|---|---|
| J | | | | 9 |
| | 9 | | A | |
| | | 9 | | |
| | | | | |
| | | | | |

PAYLINE 11
3 OF A KIND

| | | | | |
|---|---|---|---|---|
| | | | | |
| | | | | |
| | | 9 | | |
| | A | | A | |
| A | | | | Q |

PAYLINE 12
TWO PAIR

| | | | | |
|---|---|---|---|---|
| | | | | |
| | | Q | | |
| | Q | A | A | |
| | | J | | |
| | | | | |

GAME OVER

| | | | | |
|---|---|---|---|---|
| J | A | Q | A | 9 |
| A | 9 | Q | A | J |
| 9 | Q | A | A | J |
| 9 | A | J | A | Q |
| A | J | 9 | A | Q |

| | | | | |
|---|---|---|---|---|
| | | | | |
| | | | | |
| | | | | |
| | | | | |
| | | | | |

| | | | | |
|---|---|---|---|---|
| | | | | |
| | | | | |
| | | | | |
| | | | | |
| | | | | |

FIG. 3h

INSERT COIN
MAX BET PLACED ON ALL PAYLINES

| | | | | |
|---|---|---|---|---|
| | | | | |
| | | | | |
| | | | | |
| | | | | |
| | | | | |

DEAL CARDS

| | | | | |
|---|---|---|---|---|
| | | | | |
| | | | | |
| A | 4 | 7 | K | 3 |
| | | | | |
| | | | | |

HOLD CARDS

| | | | | |
|---|---|---|---|---|
| | | | | |
| | | | | |
| A | | | | |
| | | | | |
| | | | | |

DRAW CARDS
BONUS LINES DISPLAY CARDS

| | | | | |
|---|---|---|---|---|
| J | A | | | 9 |
| | 9 | | A | J |
| A | J | 9 | | |
| 9 | A | J | | |
| 9 | | | A | J |

DRAW COMPLETED

| | | | | |
|---|---|---|---|---|
| J | A | Q | A | 9 |
| A | 9 | Q | A | J |
| A | J | 9 | A | Q |
| 9 | A | J | A | Q |
| 9 | Q | A | A | J |

PAYLINE 1 / GAME HAND
PAIR OF ACES

| | | | | |
|---|---|---|---|---|
| | | | | |
| | | | | |
| A | J | 9 | A | Q |
| | | | | |
| | | | | |

PAYLINE 2
TWO PAIR

| | | | | |
|---|---|---|---|---|
| J | | | | |
| A | | | | |
| A | | | | |
| 9 | | | | |
| 9 | | | | |

PAYLINE 3
PAIR OF ACES

| | | | | |
|---|---|---|---|---|
| | A | | | |
| | 9 | | | |
| | J | | | |
| | A | | | |
| | Q | | | |

PAYLINE 4
PAIR OF ACES

| | | | | |
|---|---|---|---|---|
| | | Q | | |
| | | Q | | |
| | | 9 | | |
| | | J | | |
| | | A | | |

PAYLINE 5
PAIR OF ACES

| | | | | |
|---|---|---|---|---|
| | | | A | |
| | | | A | |
| | | | A | |
| | | | A | |
| | | | A | |

PAYLINE 6
TWO PAIR

| | | | | |
|---|---|---|---|---|
| | | | | 9 |
| | | | | J |
| | | | | Q |
| | | | | Q |
| | | | | J |

PAYLINE 7
PAIR OF ACES

| | | | | |
|---|---|---|---|---|
| | | | | J |
| | | | A | |
| | | 9 | | |
| | A | | | |
| 9 | | | | |

PAYLINE 8
2 PAIR

| | | | | |
|---|---|---|---|---|
| J | | | | |
| | 9 | | | |
| | | 9 | | |
| | | | A | |
| | | | | J |

PAYLINE 9
2 PAIR

| | | | | |
|---|---|---|---|---|
| J | | | | 9 |
| | | | | |
| | | 9 | | |
| | | | | |
| A | | | | J |

PAYLINE 10
3 OF A KIND

| | | | | |
|---|---|---|---|---|
| J | | | | 9 |
| | 9 | | A | |
| | | 9 | | |
| | | | | |
| | | | | |

PAYLINE 11
3 OF A KIND

| | | | | |
|---|---|---|---|---|
| | | | | |
| | | | | |
| | | 9 | | |
| | A | | A | |
| A | | | | J |

PAYLINE 12
TWO PAIR

| | | | | |
|---|---|---|---|---|
| | | | | |
| | | Q | | |
| | A | 9 | A | |
| | | J | | |
| | | | | |

GAME OVER

| | | | | |
|---|---|---|---|---|
| J | A | Q | A | 9 |
| A | 9 | Q | A | J |
| A | J | 9 | A | Q |
| 9 | A | J | A | Q |
| 9 | Q | A | A | J |

| | | | | |
|---|---|---|---|---|
| | | | | |
| | | | | |
| | | | | |
| | | | | |
| | | | | |

| | | | | |
|---|---|---|---|---|
| | | | | |
| | | | | |
| | | | | |
| | | | | |
| | | | | |

FIG. 5a

INSERT COIN
MAX BET PLACED ON ALL PAYLINES

| | | | | |
|---|---|---|---|---|
| BONUS LINE | | | | |
| BONUS LINE | | | | |
| | | | | |

DEAL CARDS

| | | | | |
|---|---|---|---|---|
| BONUS LINE | | | | |
| BONUS LINE | | | | |
| A | K | 7 | K | 3 |

HOLD CARDS

| | | | | |
|---|---|---|---|---|
| BONUS LINE | | | | |
| BONUS LINE | | | | |
| A | | | | |

DRAW CARDS
BONUS LINES DISPLAY CARDS

| | | | | |
|---|---|---|---|---|
| | | | A | |
| | A | | | |
| A | J | 9 | | |

DRAW COMPLETED

| | | | | |
|---|---|---|---|---|
| K | 8 | Q | A | K |
| 8 | A | A | Q | Q |
| A | J | 9 | A | Q |

PAYLINE 1 / GAME HAND
PAIR OF ACES

| | | | | |
|---|---|---|---|---|
| | | | | |
| | | | | |
| A | J | 9 | A | Q |

PAYLINE 2
PAIR OF KINGS

| | | | | |
|---|---|---|---|---|
| K | | | | K |
| | A | | Q | |
| | | 9 | | |

GAME OVER
PAYLINE 3
FULL HOUSE

| | | | | |
|---|---|---|---|---|
| K | 8 | Q | A | K |
| 8 | A | A | Q | Q |
| A | J | 9 | A | Q |

OPTIONAL PAYLINE CONFIGURATIONS

LINES CAN BE SUBSTITUTED FOR EXISTING LINE OR ADDED TO INCREASE LINES PER GAME

| | | | | |
|---|---|---|---|---|
| | | | A | K |
| | | A | | |
| A | J | | | |

| | | | | |
|---|---|---|---|---|
| K | 8 | | | |
| | | A | | |
| | | | A | Q |

| | | | | |
|---|---|---|---|---|
| | | Q | | |
| | A | A | Q | |
| | | 9 | | |

| | | | | |
|---|---|---|---|---|
| K | | | | |
| | A | A | Q | |
| | | | | Q |

| | | | | |
|---|---|---|---|---|
| K | 8 | Q | A | K |
| | | | | |
| | | | | |

| | | | | |
|---|---|---|---|---|
| | | | | |
| 8 | A | A | Q | Q |
| | | | | |

| | | | | |
|---|---|---|---|---|
| | 8 | | A | |
| 8 | | A | | Q |
| | | | | |

| | | | | |
|---|---|---|---|---|
| | | | | |
| 8 | | A | | Q |
| | J | | A | |

| | | | | |
|---|---|---|---|---|
| K | | | | K |
| | | A | | |
| A | | | | Q |

| | | | | |
|---|---|---|---|---|
| | | | | |
| | A | A | Q | |
| A | | | | Q |

| | | | | |
|---|---|---|---|---|
| A | | | | J |
| | A | A | Q | |
| | | | | |

| | | | | |
|---|---|---|---|---|
| | 8 | | A | |
| | | A | | |
| | J | | A | |

FIG. 5e

INSERT COIN

MAX BET PLACED ON ALL PAYLINES

| | | | | |
|---|---|---|---|---|
| | | | | |
| | | | | |
| | | | | |
| | | | | |
| | | | | |

DEAL CARDS

| | | | | |
|---|---|---|---|---|
| | | | | |
| | | | | |
| | | | | |
| | | | | |
| A | 4 | 7 | K | 3 |

HOLD CARDS

| | | | | |
|---|---|---|---|---|
| | A | | | |
| | | | A | |
| | | | A | |
| | A | | | |
| A | | | | |

DRAW CARDS

| | | | | |
|---|---|---|---|---|
| | A | | | |
| | | | A | |
| | | | A | |
| | A | | | |
| A | J | 9 | | |

DRAW COMPLETED

| | | | | |
|---|---|---|---|---|
| 4 | A | Q | K | 6 |
| K | 2 | J | A | 8 |
| 3 | 7 | 9 | A | 5 |
| 8 | A | 6 | Q | J |
| A | J | 9 | A | Q |

PAYLINE 1 / GAME HAND

PAIR OF ACES

| | | | | |
|---|---|---|---|---|
| | | | | |
| | | | | |
| | | | | |
| | | | | |
| A | J | 9 | A | Q |

PAYLINE 2

NO WIN

| | | | | |
|---|---|---|---|---|
| | | | | |
| | | | | |
| | | | | |
| 8 | A | 6 | Q | J |
| | | | | |

PAYLINE 3

NO WIN

| | | | | |
|---|---|---|---|---|
| | | | | |
| | | | | |
| 3 | 7 | 9 | A | 5 |
| | | | | |
| | | | | |

PAYLINE 4

NO WIN

| | | | | |
|---|---|---|---|---|
| | | | | |
| K | 2 | J | A | 8 |
| | | | | |
| | | | | |
| | | | | |

PAYLINE 5

NO WIN

| | | | | |
|---|---|---|---|---|
| 4 | A | Q | K | 6 |
| | | | | |
| | | | | |
| | | | | |
| | | | | |

PAYLINE 6

PAIR OF ACES

| | | | | |
|---|---|---|---|---|
| A | | | | |
| K | | | | |
| 3 | | | | |
| 8 | | | | |
| A | | | | |

PAYLINE 7

PAIR OF ACES

| | | | | |
|---|---|---|---|---|
| | A | | | |
| | 2 | | | |
| | 7 | | | |
| | A | | | |
| | J | | | |

PAYLINE 8

NO WIN

| | | | | |
|---|---|---|---|---|
| | | Q | | |
| | | J | | |
| | | 9 | | |
| | | 6 | | |
| | | 9 | | |

PAYLINE 9

3 OF A KIND ACES

| | | | | |
|---|---|---|---|---|
| | | | K | |
| | | | A | |
| | | | A | |
| | | | Q | |
| | | | A | |

PAYLINE 10

NO WIN

| | | | | |
|---|---|---|---|---|
| | | | | 6 |
| | | | | 8 |
| | | | | 5 |
| | | | | J |
| | | | | Q |

PAYLINE 11

THREE OF A KIND ACES

| | | | | |
|---|---|---|---|---|
| | | | | 6 |
| | | | A | |
| | | 9 | | |
| | A | | | |
| A | | | | |

PAYLINE 12

PAIR OF QUEENS

| | | | | |
|---|---|---|---|---|
| 4 | | | | |
| | 2 | | | |
| | | 9 | | |
| | | | Q | |
| | | | | Q |

GAME OVER

| | | | | |
|---|---|---|---|---|
| 4 | | | | |
| | 2 | | | |
| | | 9 | | |
| | | | | |
| A | J | 9 | A | Q |

| | | | | |
|---|---|---|---|---|
| | | | | |
| | | | | |
| | | | | |
| | | | | |
| | | | | |

| | | | | |
|---|---|---|---|---|
| | | | | |
| | | | | |
| | | | | |
| | | | | |
| | | | | |

FIG. 5f

INSERT COIN
MAX BET PLACED ON ALL PAYLINES

DEAL CARDS

| | | | | |
|---|---|---|---|---|
| | | | | |
| | | | | |
| A | 4 | 7 | K | 3 |
| | | | | |
| | | | | |

HOLD CARDS

| | | | | |
|---|---|---|---|---|
| | A | | | |
| | | | A | |
| A | | | | |
| | A | | | |
| | | | A | |

DRAW CARDS

| | | | | |
|---|---|---|---|---|
| | A | | | |
| | | | A | |
| A | J | 9 | | |
| | A | | | |
| | | | A | |

DRAW COMPLETED

| | | | | |
|---|---|---|---|---|
| 4 | A | Q | K | 6 |
| K | 2 | J | A | 8 |
| A | J | 9 | A | Q |
| 8 | A | 6 | Q | J |
| 3 | 7 | 9 | A | 5 |

PAYLINE 1 / GAME HAND
PAIR OF ACES

| | | | | |
|---|---|---|---|---|
| | | | | |
| | | | | |
| A | J | 9 | A | Q |
| | | | | |
| | | | | |

PAYLINE 2
NO WIN

| | | | | |
|---|---|---|---|---|
| | | | | |
| K | 2 | J | A | 4 |
| | | | | |
| | | | | |
| | | | | |

PAYLINE 3
NO WIN

| | | | | |
|---|---|---|---|---|
| | | | | |
| | | | | |
| | | | | |
| 8 | A | 6 | Q | J |
| | | | | |

PAYLINE 4
NO WIN

| | | | | |
|---|---|---|---|---|
| 4 | A | Q | K | 6 |
| | | | | |
| | | | | |
| | | | | |
| | | | | |

PAYLINE 5
NO WIN

| | | | | |
|---|---|---|---|---|
| | | | | |
| | | | | |
| | | | | |
| | | | | |
| 3 | 7 | 9 | A | 4 |

PAYLINE 6
PAIR OF ACES

| | | | | |
|---|---|---|---|---|
| A | | | | |
| K | | | | |
| A | | | | |
| 8 | | | | |
| 3 | | | | |

PAYLINE 7
PAIR OF ACES

| | | | | |
|---|---|---|---|---|
| | A | | | |
| | 2 | | | |
| | J | | | |
| | A | | | |
| | 7 | | | |

PAYLINE 8
NO WIN

| | | | | |
|---|---|---|---|---|
| | | Q | | |
| | | J | | |
| | | 9 | | |
| | | 6 | | |
| | | 9 | | |

PAYLINE 9
3 OF A KIND ACES

| | | | | |
|---|---|---|---|---|
| | | | K | |
| | | | A | |
| | | | A | |
| | | | Q | |
| | | | A | |

PAYLINE 10
NO WIN

| | | | | |
|---|---|---|---|---|
| | | | | 6 |
| | | | | 8 |
| | | | | Q |
| | | | | J |
| | | | | 5 |

PAYLINE 11
PAIR OF ACES

| | | | | |
|---|---|---|---|---|
| | | | | 6 |
| | | | A | |
| | | 9 | | |
| | A | | | |
| 3 | | | | |

PAYLINE 12
NO WIN

| | | | | |
|---|---|---|---|---|
| 4 | | | | |
| | 2 | | | |
| | | 9 | | |
| | | | Q | |
| | | | | 5 |

GAME OVER

| | | | | |
|---|---|---|---|---|
| | | | | |
| | | | | |
| | | | | |
| | | | | |
| | | | | |

| | | | | |
|---|---|---|---|---|
| | | | | |
| | | | | |
| | | | | |
| | | | | |
| | | | | |

| | | | | |
|---|---|---|---|---|
| | | | | |
| | | | | |
| | | | | |
| | | | | |
| | | | | |

INSERT COIN
MAX BET PLACED ON ALL PAYLINES

DEAL CARDS

HOLD CARDS

DRAW CARDS
BONUS LINES DISPLAY CARDS

DRAW COMPLETED

PAYLINE 1 / GAME HAND
PAIR OF ACES

PAYLINE 2
2 PAIR

GAME OVER
PAYLINE 3
PAIR OF QUEENS

OPTIONAL PAYLINE CONFIGURATIONS

LINES CAN BE SUBSTITUTED FOR EXISTING LINE OR ADDED TO INCREASE LINES PER GAME

FIG. 7e

INSERT COIN
MAX BET PLACED ON ALL PAYLINES

DEAL CARDS

| | | | | |
|---|---|---|---|---|
| A | 4 | 7 | K | 3 |

HOLD CARDS

| | | | | |
|---|---|---|---|---|
| A | | | | |

DRAW CARDS

| | | | | |
|---|---|---|---|---|
| A | J | 9 | | |

DRAW COMPLETED

| | | | | |
|---|---|---|---|---|
| 4 | 7 | Q | K | 6 |
| K | 2 | J | K | 8 |
| 3 | 7 | 9 | K | 5 |
| 8 | J | 6 | Q | J |
| A | J | 9 | A | Q |

PAYLINE 1 / GAME HAND
PAIR OF ACES

| | | | | |
|---|---|---|---|---|
| A | J | 9 | A | Q |

PAYLINE 2
NO WIN

| | | | | |
|---|---|---|---|---|
| 8 | J | 6 | Q | J |

PAYLINE 3
NO WIN

| | | | | |
|---|---|---|---|---|
| 3 | 7 | 9 | K | 5 |

PAYLINE 4
PAIR OF KINGS

| | | | | |
|---|---|---|---|---|
| K | 2 | J | K | 8 |

PAYLINE 5
NO WIN

| | | | | |
|---|---|---|---|---|
| 4 | 7 | Q | K | 6 |

PAYLINE 6
NO WIN

| | | | | |
|---|---|---|---|---|
| 4 | | | | |
| K | | | | |
| 8 | | | | |
| 8 | | | | |
| A | | | | |

PAYLINE 7
3 OF A KIND KINGS

| | | | | |
|---|---|---|---|---|
| | K | | | |
| | K | | | |
| | K | | | |
| | Q | | | |
| | J | | | |

PAYLINE 8
NO WIN

| | | | | |
|---|---|---|---|---|
| | | Q | | |
| | | J | | |
| | | 9 | | |
| | | 6 | | |
| | | 9 | | |

PAYLINE 9
3 OF A KIND KINGS

| | | | | |
|---|---|---|---|---|
| | | | K | |
| | | | K | |
| | | | K | |
| | | | Q | |
| | | | A | |

PAYLINE 10
NO WIN

| | | | | |
|---|---|---|---|---|
| | | | 6 | |
| | | | 8 | |
| | | | 5 | |
| | | | J | |
| | | | Q | |

PAYLINE 11
NO WIN

| | | | | |
|---|---|---|---|---|
| | | | | 6 |
| | | | K | |
| | | 9 | | |
| | Q | | | |
| A | | | | |

PAYLINE 12
PAIR OF QUEENS

| | | | | |
|---|---|---|---|---|
| 4 | | | | |
| | K | | | |
| | | 9 | | |
| | | | Q | |
| | | | | Q |

GAME OVER

INSERT COIN

MAX BET PLACED ON ALL PAYLINES

DEAL CARDS

HOLD CARDS

DRAW CARDS

DRAW COMPLETED

PAYLINE 1 / GAME HAND

PAIR OF ACES

PAYLINE 2

PAIR OF KINGS

PAYLINE 3

PAIR OF JACKS

PAYLINE 4

NO WIN

PAYLINE 5

NO WIN

PAYLINE 6

NO WIN

PAYLINE 7

3 OF A KIND KINGS

PAYLINE 8

NO WIN

PAYLINE 9

3 OF A KIND KINGS

PAYLINE 10

NO WIN

PAYLINE 11

NO WIN

PAYLINE 12

NO WIN

GAME OVER

MULTI-LINE POKER VIDEO GAMING APPARATUS AND METHOD

FIELD OF THE INVENTION

This invention relates in general to a method and apparatus providing a multi-line poker game in a video gaming device. More specifically, the present invention relates providing a plurality of paylines that enable multiple poker hands to be wagered upon and played by a player within a single play of a poker game on a computer-based video gaming device.

BACKGROUND OF THE INVENTION

Computer-based, video gaming machines are becoming increasing common place to construct gaming devices such as slot machines, video poker games, and video roulette wheels. These automated video games utilize computing systems containing software modules to implement gaming logic. These computing systems also utilize computer video display devices to present gaming players with images of the various gaming apparatus being implemented.

These computer-based gaming systems replace mechanical systems such as slot machines comprising a plurality of rotating wheels and associated mechanical logic. The computing systems utilize a random number generator to determine a game outcome that statistically appears to be random in nature. The random numbers obtained from a random number-generating module are used to determine which symbols on the wheels of a slot machine are to be displayed when the game concludes a play. Similarly, these random numbers are used to shuffle standard decks of playing cards used in other games of chance such as poker.

These computer-based gaming machines also comprise software modules which when working together implement the rules of a particular game of chance. For a poker gaming machine, these rules include the pay-out tables used to determine any winnings paid to a player for a particular combination of winning combinations of cards found within on a particular hand. These hands may be constructed from any arrangement of cards that can form a hand of poker.

Gaming machines that accept wagers and provide winning payouts as part of their operation. In order to attract players, the gaming machines need to entice players to want to play a given machine. Additionally, the excitement from a given play of a gaming machine increases, and thus the corresponding desire of a player to place wagers, as the number of ways a player may win increases.

At the same time, the gaming establishment operators desire for players to increase the amount of wagers placed within a given time period as the games are programmed to statistically return a predetermined amount of funds wagered. As the amount wagered increases, the amount of profit to the establishment operators. statistically increases as well. Thus gaming machines are successful when they provide numerous ways for a player to win as well as increases the incentives for players to place an increased number of wagers on a given play. The present invention provides a software architecture for implementing computer-based gaming machines to address the above problems in prior systems.

SUMMARY OF THE INVENTION

One aspect of the present invention is a method of playing a multi-line poker game of cards having a game hand line and a plurality of bonus lines that are combined to create a game array having a plurality of paylines on a computer-based video gaming device, the method comprises determining a set of game parameters from a set of input signals from a player, randomly dealing a plurality of cards from a deck of cards to fill the game hand line; determining the cards from the within the game hand that are to be held and the cards that are to be discarded, randomly dealing cards from the deck of cards to replace all of the cards discarded from within the game hand, duplicating each card within the game hand and randomly placing the duplicated cards within the plurality of bonus lines until all of the locations within the game array are filled with cards, determining whether any of the paylines contain winning combinations of poker hands, and determining an award amount for all winning combinations found within paylines based upon the winning combination, the identity of the payline, and the amount of any wager placed on the payline containing the winning combination.

Another aspect of the present invention is a method of playing a multi-line poker game of cards having a game hand line and a plurality of bonus lines that are combined to create a game array having a plurality of paylines on a computer-based video gaming device, the method comprises determining a set of game parameters from a set of input signals from a player, randomly dealing a plurality of cards from a deck of cards to fill the game hand line; determining the cards from the within the game hand that are to be held and the cards that are to be discarded, randomly dealing cards from the deck of cards to replace all of the cards discarded from within the game hand within the game hand, duplicating each card held within the game hand and randomly placing the duplicated cards within the plurality of bonus lines, randomly dealing additional cards to fill the game array until all of the locations within the game array are filled with cards, determining whether any of the paylines contain winning combinations of poker hands, and determining an award amount for all winning combinations found within paylines based upon the winning combination, the identity of the payline, and the amount of any wager placed on the payline containing the winning combination.

Yet another aspect of the present invention is a method of playing a multi-line poker game of cards having a game hand line and a plurality of bonus lines that are combined to create a game array having a plurality of paylines on a computer-based video gaming device, the method comprises determining a set of game parameters from a set of input signals from a player, randomly dealing a plurality of cards from a deck of cards to fill the game hand line; determining the cards from the within the game hand that are to be held and the cards that are to be discarded, randomly dealing cards from the deck of cards to replace all of the cards discarded from within the game hand, randomly dealing cards from the deck of cards and randomly placing the duplicated cards within the plurality of bonus lines until all of the locations within the game array are filled with cards, determining whether any of the paylines contain winning combinations of poker hands, and determining an award amount for all winning combinations found within paylines based upon the winning combination, the identity of the payline, and the amount of any wager placed on the payline containing the winning combination.

BRIEF DESCRIPTION OF THE DRAWINGS

In the following description of the exemplary embodiment, reference is made to the accompanying drawings that form a part hereof, and in which is shown by way of illustration the specific embodiment in which the invention may be practiced. It is to be understood that other embodiments may be utilized as structural changes may be made without departing from the scope of the present invention.

FIGS. 3*a–h* illustrate a series of game sequence illustrations for multi-line poker played according to a first exemplary embodiment of the present invention.

FIGS. 5*a–f* illustrate a series of game sequence illustrations for multi-line poker played according to a second exemplary embodiment of the present invention.

FIGS. 7*a–f* illustrate a series of game sequence illustrations for multi-line poker played according to a third exemplary embodiment of the present invention.

DETAILED DESCRIPTION

In general terms, the present invention relates to providing a multi-line poker game within a computer-based video gaming device. More specifically, the present invention relates providing a plurality of paylines that enable multiple poker hands to be wagered upon and played by a player within a single play of a poker game on a computer-based video gaming device.

Multi-line poker is a specific five card poker game utilized for the creation of any of the following: video gaming machines, amusement games, "add on" bonusing systems and video lottery terminals. The game utilizes a 5-card video poker game, or as sometimes referred to as poker solitaire game. The video poker game deals 5 cards, allows the player to discard or hold between 1 and 5 of the dealt cards, and then draw one time to fill the discarded positions. A player then compares card combinations to a displayed award table. The award table indicates winner card combinations and the award amount for each winning combination. Wagers are permitted on one or more paylines containing the cards that are part of the poker hand drawn. Winning combinations for each payline are paid the appropriate award amount. A payline is a set of 5 cards taken from positions within an n-by-m array in which the drawn cards are located within the positions of the array.

The Multi-line poker game allows the player the opportunity of additional wins and a higher hit frequency through the use of added paylines to the game that the player can use to achieve a win. The player selects their paylines by placing bets on these additional paylines and then plays standard poker, deal-hold-draw. The player has only one hand to play, the game hand. The additional combinations occur without player involvement, other than holding and drawing in the game hand. The payline winners are identified and displayed by game to player during pay sequence.

Figure 1A:
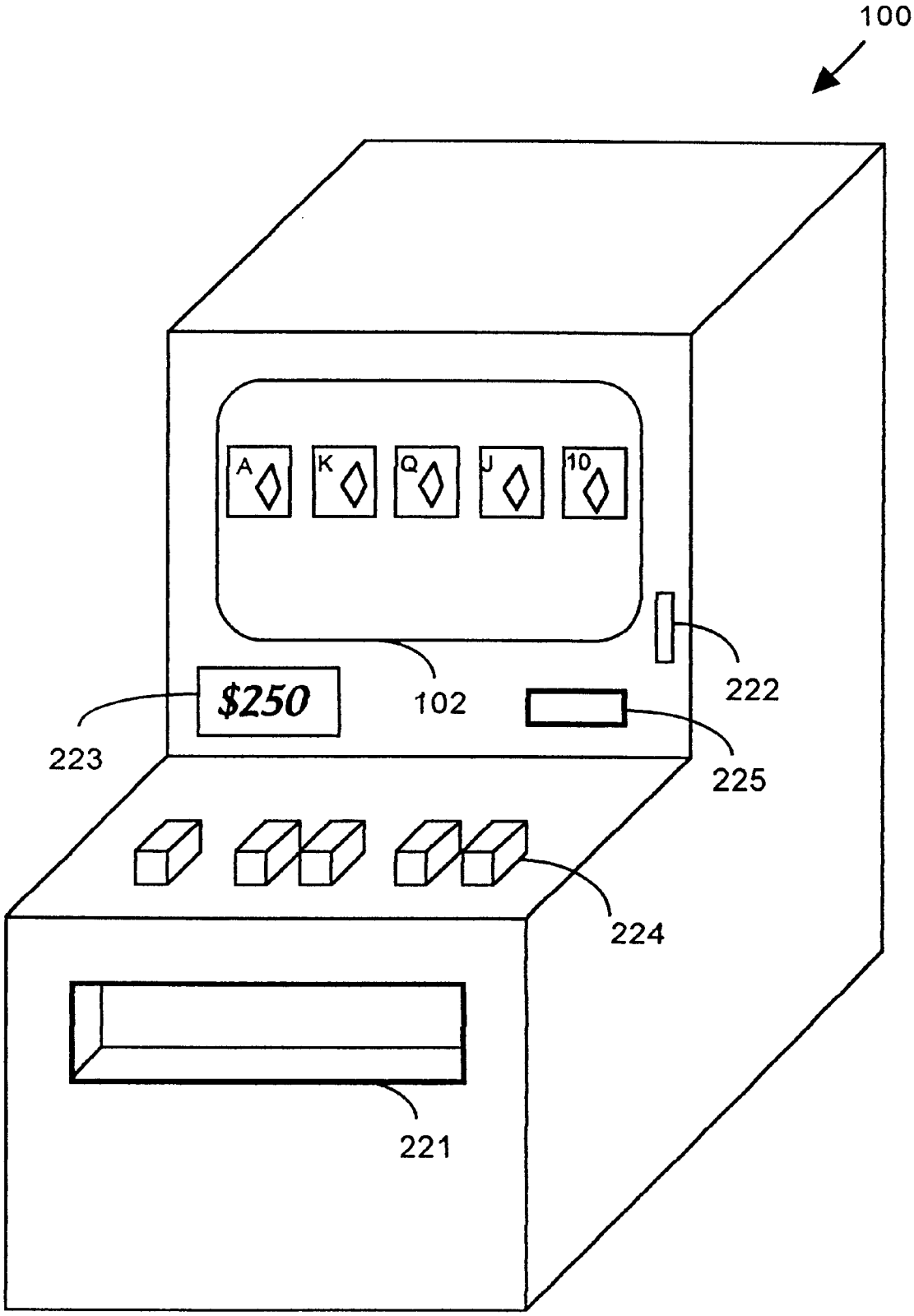
FIGS. 1*a–b* illustrate a set of logical block diagrams for a video gaming machine used to implement a Multi-Line Poker Gaming machine according to an example embodiment of the present invention.

FIG. 1*a* illustrates a video-based gaming machine according to one embodiment of the present invention. A gaming device 100 is used to implement the video-based gaming machine and comprises a video display device 102, user controls 224, a hopper 221, and wager input modules 222 and 225. Within the gaming device 100, a computing system is utilized to operate the gaming device 100 and generate the video images displayed upon the video display device 102.

Figure 1B:
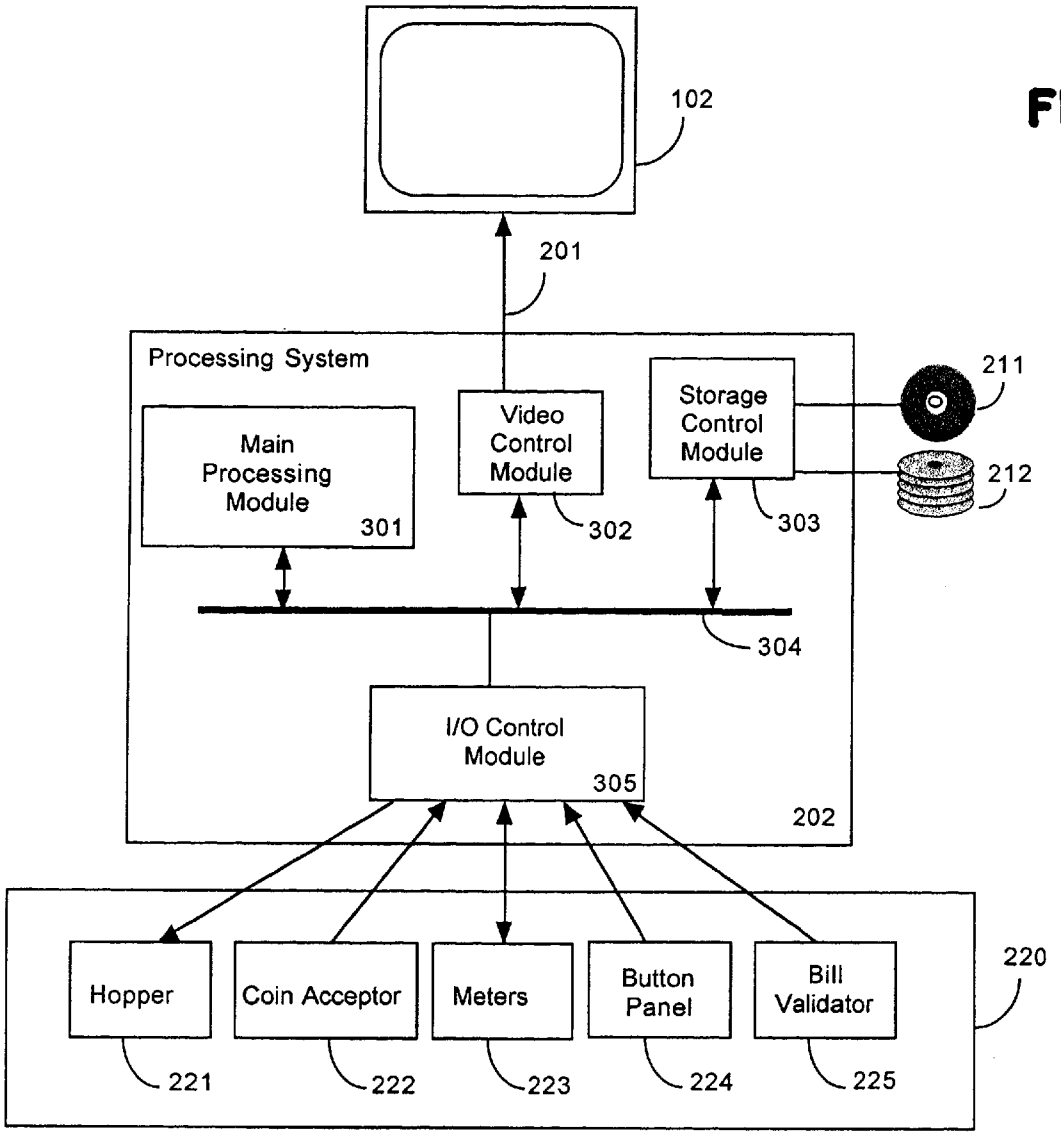

Now referring to FIG. 1*b*, a logical block diagram for a computer-based gaming system used to implement gaming device 100 is illustrated. The computer-based gaming system 200 comprises a plurality of mass storage devices 211–212, a video connection 201 to video display device 102, and a plurality of user interface units 220. The user interface units 220 comprise a hopper 221, a coin acceptor 222, a set of meters 223, a button panel 224, and a bill validator 225.

The hopper 221 provides a game player with tokens or coins representing something of value returned when the game player places a wager on an outcome of a play of the game resulting in a successful outcome for the game player. The hopper 221 may be configured to return these winnings from the outcome of each play of the game. The hopper 221 may also be configured to return a current balance of funds maintained within the gaming device 100 upon receiving a command from the game player. In the latter embodiment, the winnings from any given outcome from a play of the game are added to a current balance maintained within the processing system 202. This current balance may be displayed upon one of the set of meters 223. The game player may also place wagers on the outcome of the play of the game from the current balance.

The coin acceptor 222 and the bill validator 225 provide the game player with ability to input coins, tokens, or paper bills representing currency into the gaming device 100 for use in making wagers on the outcome of a play of the game. The game player may input coins or tokens into the coin acceptor 222, and may input bills into the bill validator 225 before each play of the game is initiated. The player may also input these coins or other forms of money into the gaming device 100 to create the current balance, which is used to wager on a series of outcomes from the game.

The button panel 224 comprises a plurality of user input buttons used to control the operation of the game. These buttons may comprise a button to start a game, a button to return the current balance to the hopper 221, and one or more buttons to determine the amount of finds to be wagered on the outcome of the next play of the game. The game player depresses these buttons to provide a command to the processing system 202 how to proceed with the operation of the gaming device 100.

The processing system 202 comprises a main processing module 301, a video control module 302, a storage control module 303, and an I/O control module 305. Each of these modules are coupled together using a system communications bus 304. The video display device 102 is coupled to the video control module 302 to display images generated by the processing system 202 to the game player. The mass storage devices 211–212 are coupled to the storage control module 303 to provide the processing system with mass memory storage for the data and program files needed to implement the gaming device 100.

According to the preferred embodiment, the processing system 202 is implemented using a computing system typically referred to as a personal computer. The computing system typically uses a PCI type system bus to implement the system communications bus 304. This choice to implement the preferred embodiment permits the main processing module 301, the video control module 302, and the storage control module 303 to be implemented with a wide variety of commonly available system components. This choice also permits the periodic improvement of the processing system 202 with the upgrade of one of these modules as new and faster computing modules become available. The preferred embodiment utilizes a main processing module 301 based upon a PENTIUM II processor manufactured by the INTEL. One of ordinary skill in the art will recognize that this processing unit may be based upon any number of alternate processing units manufactured by ADVANCES MICRO DEVICES, CYRIX and other manufacturers as well as a POWERPC processor manufactured by IBM and MOTOROLA.

The I/O control module 305 is a custom logic interface module for providing connections between the user interface units 220 and the processing system 202. Each of the various user interface units 220 comprise one or more electromechanical device that interacts with the game player. These units 220 accept electrical signals generated by the I/O control module 305 instructing the units to perform an operation. These units 220 also generate electrical signals accepted by the I/O control module 305 for use by the software modules executing within the main processing module 301.

The video gaming device 100 has software modules that execute within the processing system 202 to implement the multi-line poker video gaming device. The software modules perform the operations needed to perform the poker game, generates signals necessary to display the video images of the poker game, and determines any award amounts corresponding to winning combinations on paylines having wagers placed upon them.

The embodiments of the invention described herein are implemented as logical operations in a video gaming device. The logical operations are implemented (1) as a sequence of computer implemented steps running on a computer system and (2) as interconnected machine modules running within the computing system. This implementation is a matter of choice dependent on the performance requirements of the computing system implementing the invention. Accordingly, the logical operations making up the embodiments of the invention described herein are referred to as operations, steps, or modules. It will be recognized by one of ordinary skill in the art that these operations, steps, and modules may be implemented in software, in firmware, in special purpose digital logic, and any combination thereof without deviating from the spirit and scope of the present invention as recited within the claims attached hereto.

Figure 2A:
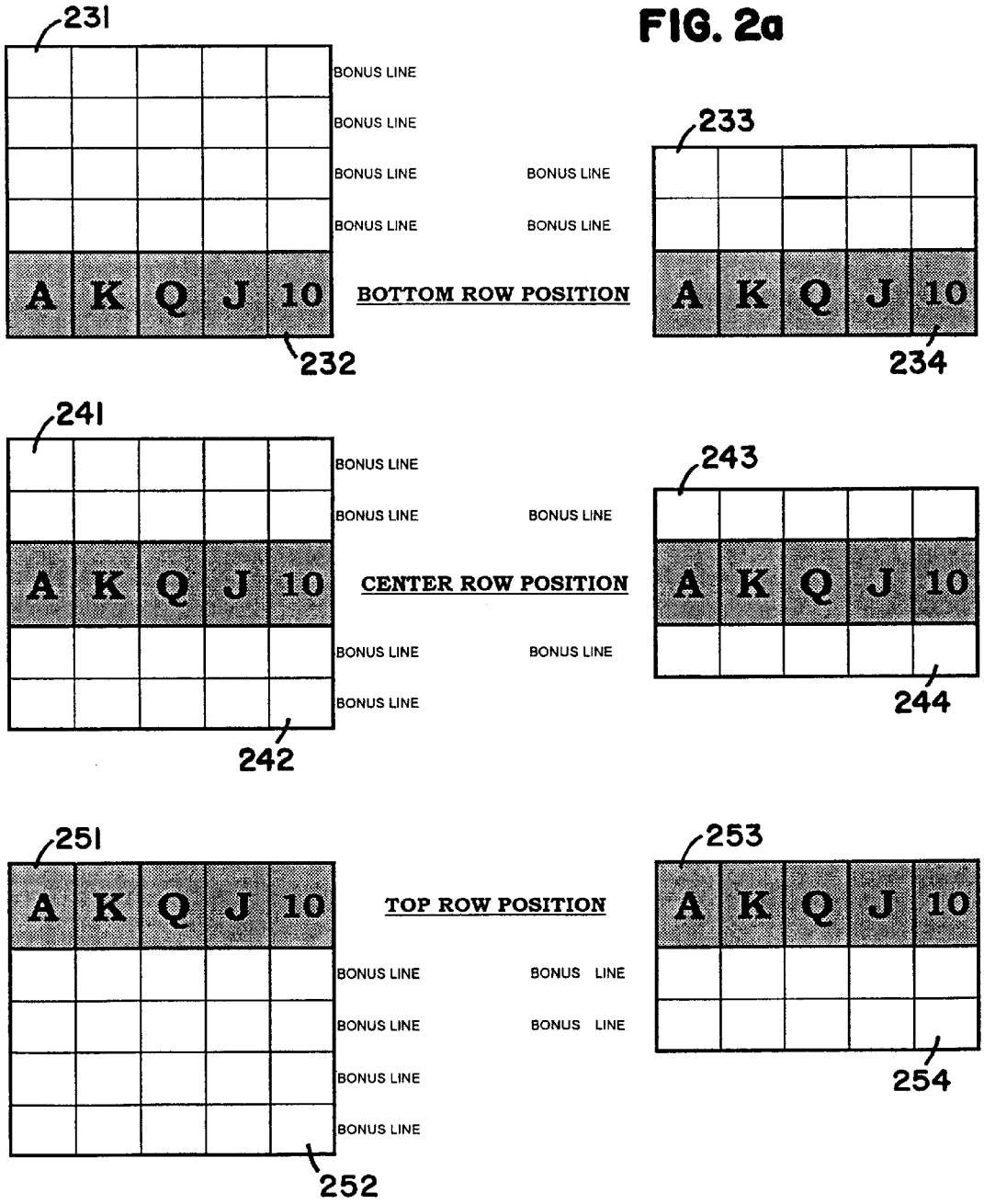
FIGS. 2*a–c* illustrate various multi-line poker game hand configurations according to another embodiment of the present invention.
Figure 2B:
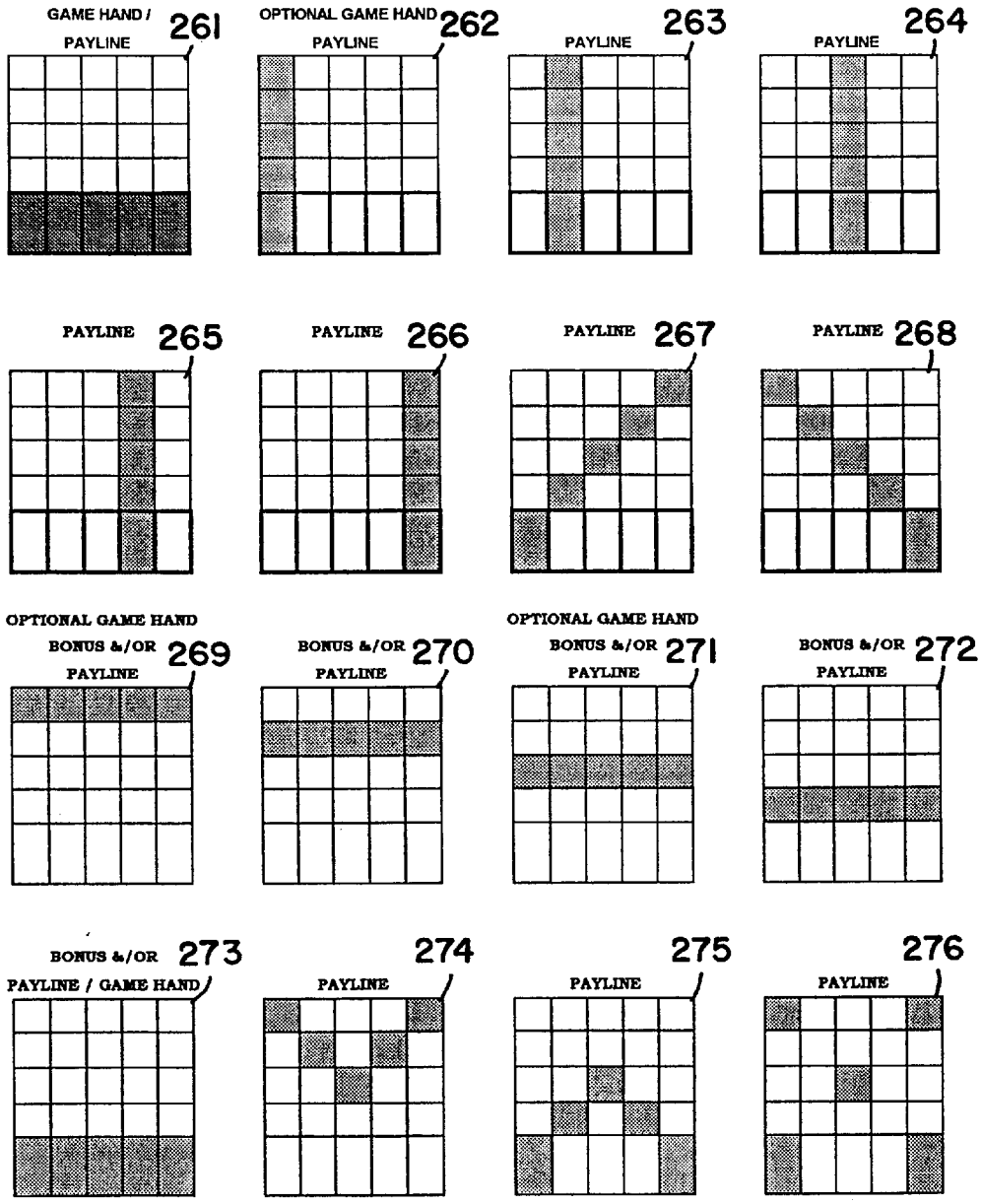
Figure 2C:
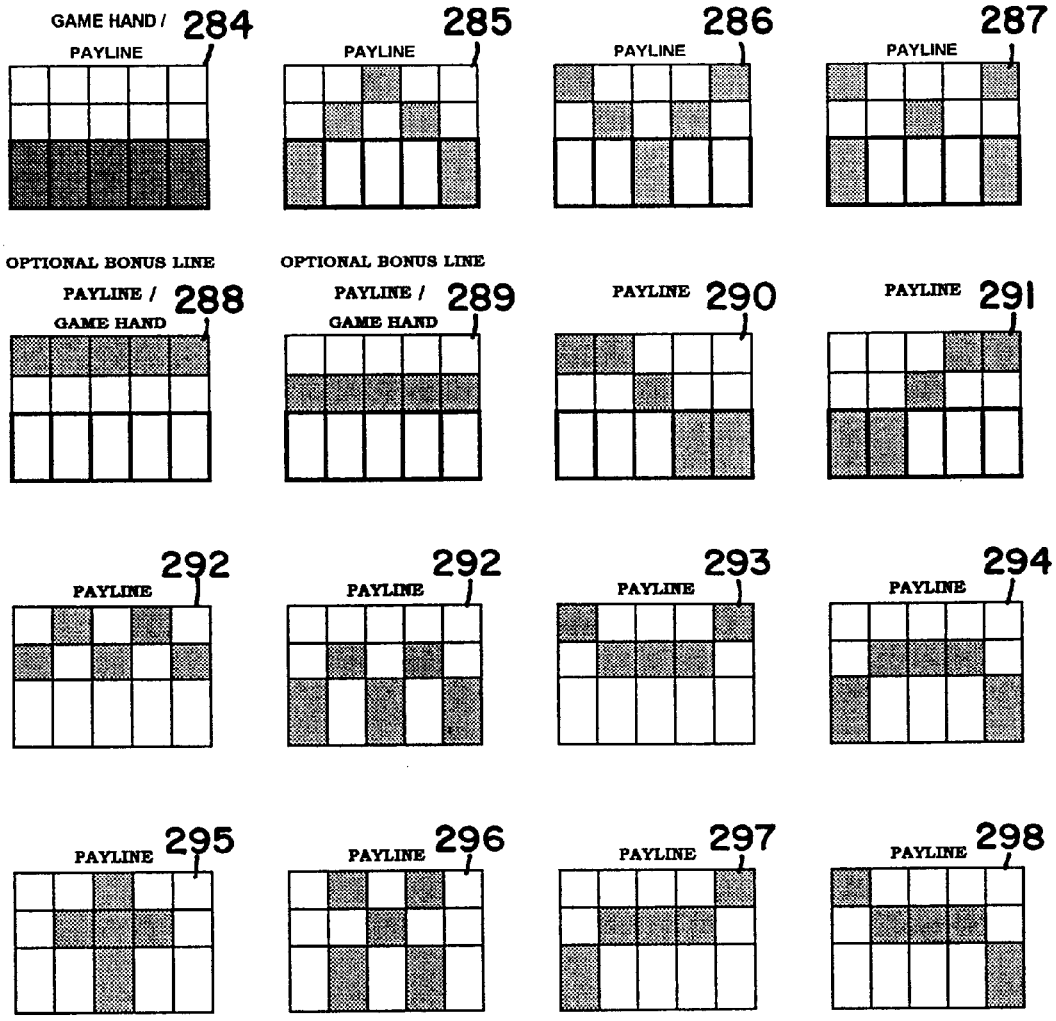

FIGS. 2*a–c* illustrate various multi-line poker game hand configurations according to another embodiment of the present invention. FIG. 2*a* illustrates 5×5 and 3×5 game hand configurations in which the game hand is in a bottom row position 231 and 233, a center row position 241 and 243, and a top row position 251 and 253. For each game according to the present invention the game utilizes an n by m array where the n indicates the number of rows and m indicates the number of columns in the array. For all of the descriptions presented herein, the upper left comer of the array corresponds to position (1,1) and the bottom right comer of the array corresponds to (n,m). In exemplary embodiments, these arrays are 3×5 and 5×5. One skilled in the art will recognize that other size arrays may be used to implement the video gaming devices without deviating from the spirit and scope of the present invention.

For each of these arrays, one row corresponds to the game hand being played within the specific variation of the rules for multi-line poker. In a bottom row position array 231 and 233, the game hand is in the row n of the array 232 and 234. In a center row position array 241 and 243, the game hand is in the row ((n/2) mod n)+1 of the array 242 and 244. In a bottom row position array 231 and 233, the game hand is in the row 1 of the array 252 and 254. The remaining rows within the array correspond to bonus lines which may be used to place additional wagers on additional paylines.

FIGS. 2*b* and 2*c* illustrate various arrangements of locations within the arrays that may be used to construct a set of paylines according to the present invention. FIG. 2*b* has a set of 5×5 arrays 261–276. FIG. 2*c* has a set of 3×5 arrays 284–298. Within each arrays 261–276, 5 array positions are indicated as darken positions for a set of 5 cards used to construct a payline. The cards placed within these positions of the array are used to define a poker hand for the payline in determining whether an award is paid for the particular payline.

In any embodiment of the multi-line poker game, the Multi-line poker has various payline configurations. These are poker/card games with a main "game hand" and an additional two through twelve "paylines". These paylines vary per game, but specifically include a three line, five line, eight line, nine line, and twelve line configurations. The specific advantage of the additional paylines is a higher hit frequency to the player and a higher coin/credit bet per game for the operator. The paylines can be configured above or below or around the "game hand". They also can be configured across and to the right of the "Game hand". Examples are provided in the "Game Hand Illustrations" following in this text. Additionally, with touch screen games, the player can create their own special combinations of 5 for their own paylines to bet.

The "game hand" is the standard hand dealt to the player. The player decides to hold or discard any or all of the five cards dealt and then draws to fill those positions. The "game hand" is the same routine that occurs now on existing video 5 card poker games. This is the main feature hand of the Multi-line poker games. Initially, until the held section occurs and the draw button or enable has been selected, the "game hand" is the only display of cards (five card positions) visible to the player. After selection and activation of the "draw" feature, the cards begin to display on the additional bonus lines. The player has completed their poker play strategy for the single "game hand". Only after this has occurred, does the game display bonus and additional payline outcome. Until this occurs only "card back" or blank spaces are visible beyond the "game hand".

The Multi-line Poker has additional paylines. These paylines intersect bonus display lines. The each bonus display line has Five (5) card positions. Each position displays one card. In a first exemplary embodiment, each bonus line will randomly re-mix the Game Hand cards and re-display them. This will occur for each of the bonus lines. This re-mixing and displaying will provide the base for the additional paylines. The bonus display lines in a second and third exemplary embodiment may become paylines as well, since new card other than the Game Hand are displayed.

FIGS. 3*a–h* illustrate a series of game sequence illustrations for multi-line poker played according to a first exemplary embodiment of the present invention. In the first exemplary embodiment, a standard poker game is expanded by randomly mixing the 5 cards that the player holds and draws in the game hand within new positions in additional bonus display. A player has the option of selecting additional paylines using additional betting credits waged on the outcome of these additional paylines. These new paylines can display new variations of the same 5 cards drawing in the "game hand". This result is achieved by intersecting the card display lines with the new paylines. These new paylines can produce of a kind from the original game hand. A pair or 3 of a kind cards held in the game hand advance an opportunity to the player to win 4 of a kinds and 5 of a kinds in the additional pay lines. Each payline is considered an additional 5-card poker hand and pays a separate awards as such. These awards vary in respect to the amount bet on that particular payline and its particular award schedule. The basic poker game hand award schedule is not effected by the results from additional paylines, sine each of the paylines are bet separately. Therefore, a desired payout, such as a 97% award returned game hand and awards schedule may be retained. The bonus lines only display the hold and draw; outcome of the "game hand".

Figure 3A:
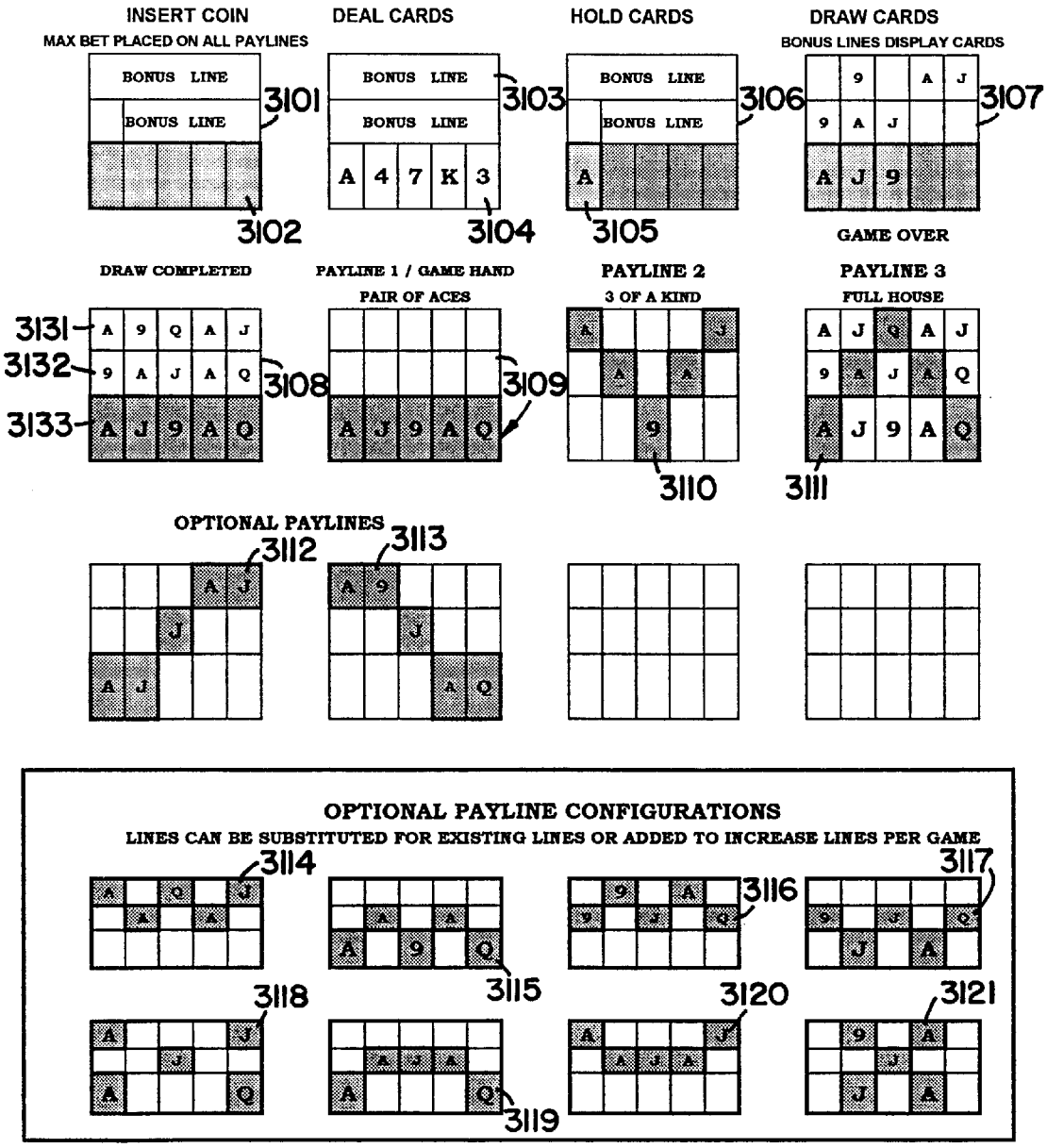
Figure 3B:
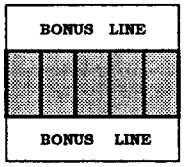
Figure 3B:
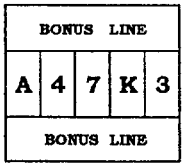
Figure 3B:
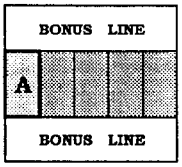
Figure 3B:
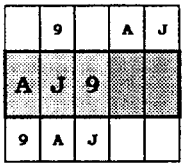
Figure 3B:
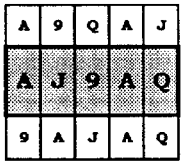
Figure 3B:
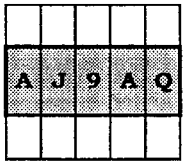
Figure 3B:
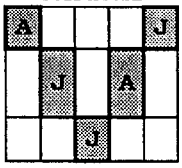
Figure 3B:
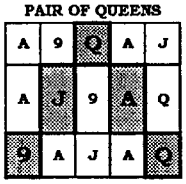
Figure 3B:
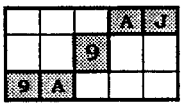
Figure 3B:
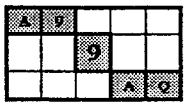
Figure 3B:
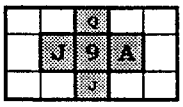
Figure 3B:
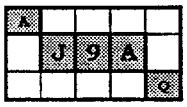
Figure 3B:
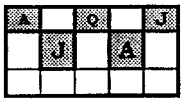
Figure 3B:
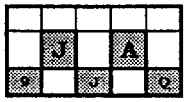
Figure 3B:
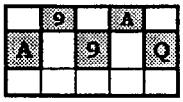
Figure 3B:
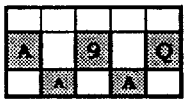
Figure 3B:
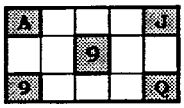
Figure 3B:
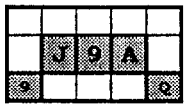
Figure 3B:
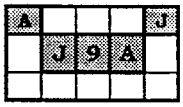
Figure 3B:
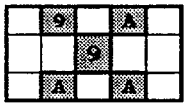

The first exemplary embodiment is best understood through the use of a sequence of example plays of the multi-line poker game. FIGS. 3*a* and 3*b* illustrate a 3 payline version of the multi-line poker game using a 3×5 array. FIG. 3*a* uses a bottom row position version of the game hand. Similarly, FIG. 3*b* uses a center row position of the game hand. In the first operation 3101, a player places wages on one or more paylines. These wagers may be based upon coins, tokens, and bills inserted into the video gaming device, or may be based upon a value contained within a register of the video gaming device from prior funds inserted into the device and any winnings from prior poker hands.

In the next operation, 3103, game hand 3104 is filled with 5 playing cards from a deck of playing cards. The cards are selected using a random number generator to select each of the 5 cards from a deck. The random number generator is configured to select each card from a deck of cards with equal probability. In the operation 3106, a player indicates which of the 5 cards within the player wishes to hold for use in the game. The player selects the card held and the cards discarded using the button panel on the gaming device. The selection of the cards may be accomplished using a button on the panel for each of the cards within the game hand in one embodiment. In other embodiments, various computer generated pointing devices such as a cursor controlled by a trackball, mouse, and arrow keys may be used to click up cards to be selected to be held or discarded.

Once the player selects the cards to be held, the non-selected cards are discarded and new cards are randomly selected from a deck to be played in the game hand to replace the discarded cards in operation 3107. Each card within the game hand are also placed within randomly-selected positions within the bonus lines of the array. The displayed array in operation 3107 illustrates this array filling process partially through the process. The game hand contains an "A", "J", and "9". Within the two bonus lines, two "A", two "J", and two "9" are randomly placed. This process continues until the 3×5 array is completely filled as shown in operation 3108.

Once the array has been filled, the various paylines having wagers are checked to determine whether they containing a winning combination. The game checks the game hand in operation 3109 and finds a pair of aces, payline 2 in operation 3110 and finds 3 of a kind, and payline 3 in operation 3111 and finds a filMl house. For each of these combinations, the awards are determined and returned to the player.

Other optional paylines 3112–3121 are also shown. These paylines may be used in place of payline 2 and 3 or may be used in addition to payline 2 and 3. Separate wagers are needed to play additional paylines along with the game hand and paylines 2 and 3.

FIG. 3*b* illustrates the same sequence of operations as shown in FIG. 3*a* with the exception that the game hand is in the center row position rather than the bottom row position. While the completed array 3208 has the same cards are the completed array above 3108, the use of the center row position for the game hand changes the location of the cards throughout the array. As a result, the results for payline 2 and 3 3210 and 3211 are different from the payline 2 and 3 above 3110 and 3111.

Figure 3C:
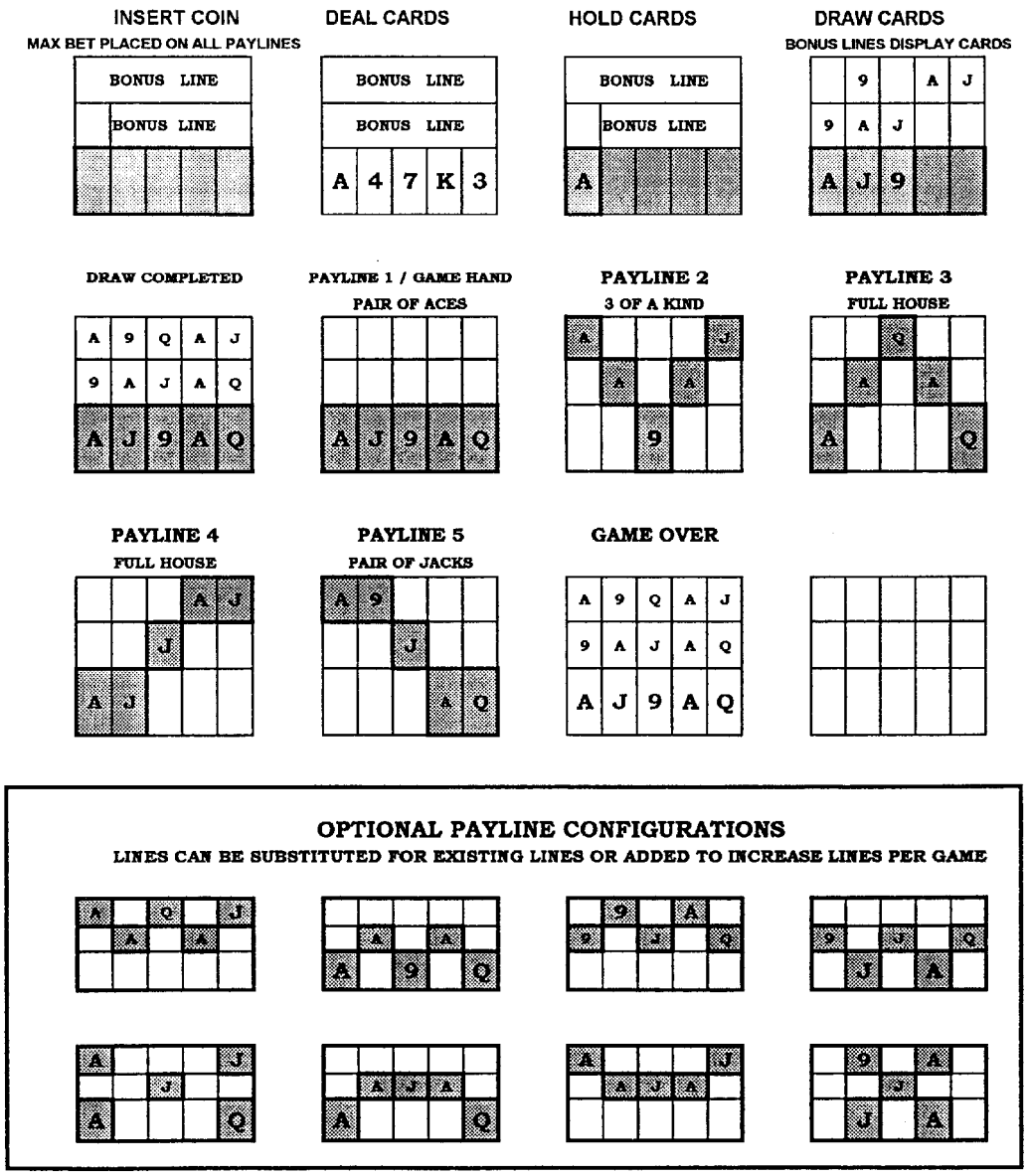
Figure 3D:
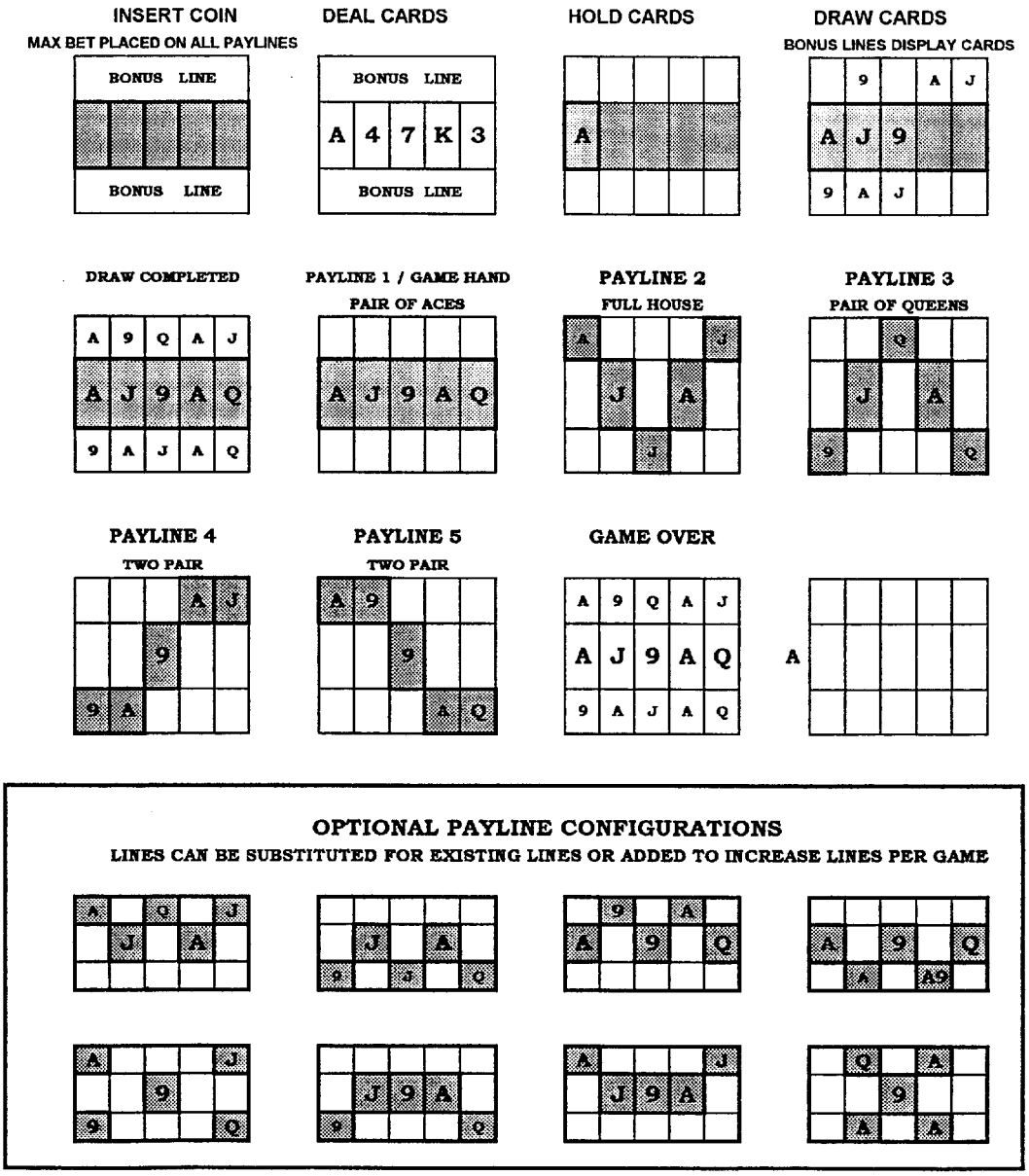

FIGS. 3*c* and 3*d* illustrate a 5 payline game sequence for an 3×5 array using the same sequence of operations discussed above with respect to FIGS. 3*a* and *b*. The sequence of operations is identical to the operations above 3101–3113 with the exception that the two optional paylines 3112 and 3113 are now played. Thus the player is required to place two additional wagers for these two additional paylines and video gaming device will check these paylines to determine the outcome for paylines 4 and 5 3312–3313 and 3412–3413.

FIGS. 3*e* and 3*f* illustrate an 8 payline game sequence for an 5×5 array using the same sequence of operations discussed above with respect to FIGS. 3*a* and *b*. Similarly, FIGS. 3*g* and 3*h* illustrate an 12 payline game sequence for an 5×5 array using the same sequence of operations discussed above with respect to FIGS. 3*a* and *b*. The sequence of operations is identical to the operations above 3101–3113 with the exception that the additional optional paylines 3112 and 3113 are now played. Thus the player is required to place additional wagers for each of two additional paylines and video gaming device will check these paylines to determine the outcome for the additional paylines played.

Figure 4:
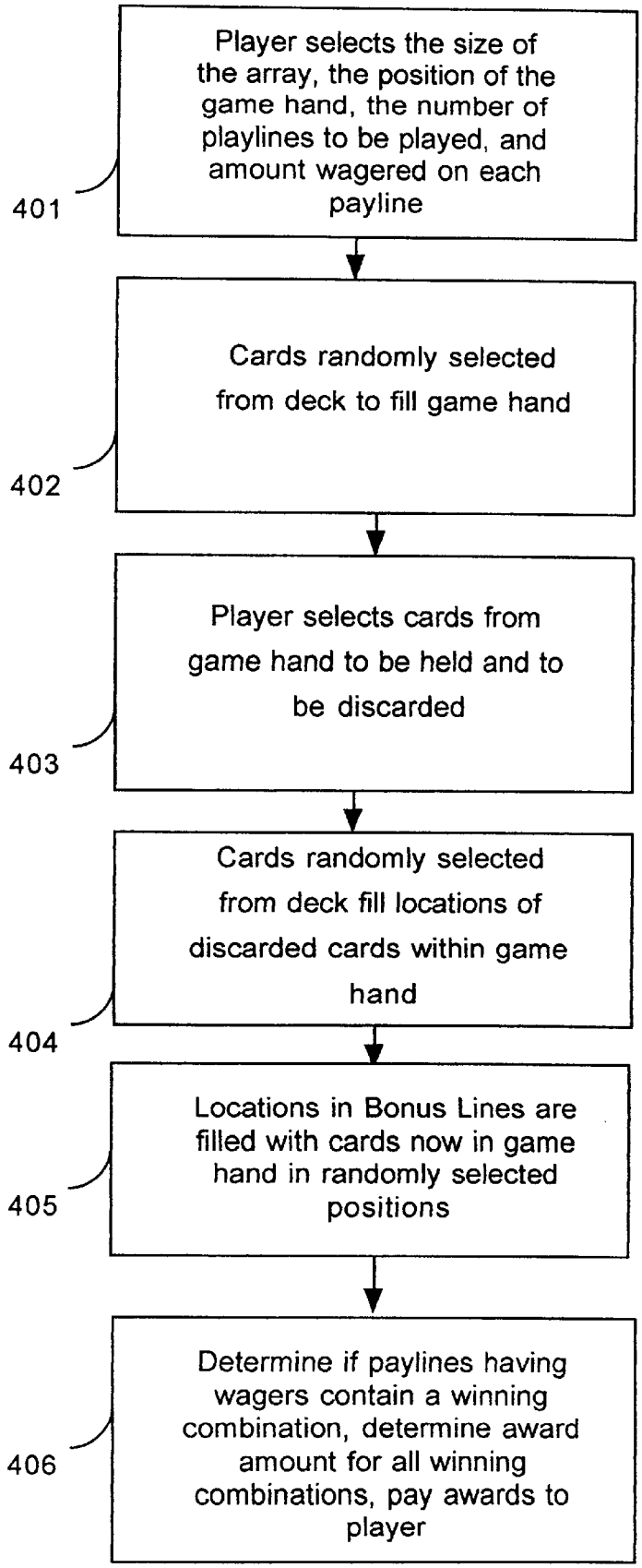
FIG. 4 illustrates a logical operational flow diagram for the operations performed by the computer-based video gaming device according to the first exemplary embodiment of the present invention.

FIG. 4 illustrates a logical operational flow diagram for the operations performed by the computer-based video gaming device according to the first exemplary embodiment of the present invention. The game begins with the player selecting a set of game parameters used to control the operation of the game in operation 401. These parameters include the size of the array, the number of paylines to be played, the amount wagered on each selected payline, and the row position for the game hand within the array. These parameters may be selected from a set of default values, may be selected from the values used by the player in a previous hand of the game, and selected from input received from the player.

Once the game parameters are selected, the game hand is filled with a set of randomly dealt cards from a standard deck of playing cards in operation 402. The player responds to these cards in the game hand by selecting the cards within the game hand to be held for continued use in the game and the cards to be discarded from future use in the game in operation 403.

The game proceeds to operation 404 after the desired cards have been discarded where the locations of these discarded cards are filled with additional cards randomly dealt from the same deck of cards. Either at the same time that the location of these discarded cards are filled with new cards, or after the location of the discarded cards are filled, the cards now in the game hand are duplicated and randomly placed within locations of the bonus lines in the game array. Each card within the game hand is duplicated the same number of times until all of the locations within the game array are filled in operation 405.

The game concludes after operation 406 in which all of the paylines in which a player places a wager are checked to determine if a winning poker hand combination is present. For each winning combination found, an award amount to be paid to the player is determined based upon the wager placed upon the payline and the specific winning combination found. The total award from all paylines wagered is paid to the player. This payout may be in the form of coins or tokens returned to the player using the hopper. The payout may also be in the form of monetary credits applied to a total maintained by the gaming device until the player indicates that he or she is finished playing the gaming device.

FIGS. 5*a–f* illustrate a series of game sequence illustrations for multi-line poker played according to a second exemplary embodiment of the present invention. This second exemplary embodiment differs from the first exemplary embodiment by not utilizing the "game hand" draw cards in filling the bonus lines. In the second exemplary embodiment, the hold cards from the game hand are displayed in the bonus display lines as well as the "game hand". However, the game hand draw cards remain with the "game hand" exclusively. New draw cards from the same deck are then selected and displayed in the additional bonus lines with the original hold cards. The bonus lines again, only display secondary game outcome. The original dealt cards not held are not displayed in the additional bonus lines.

Figure 5B:
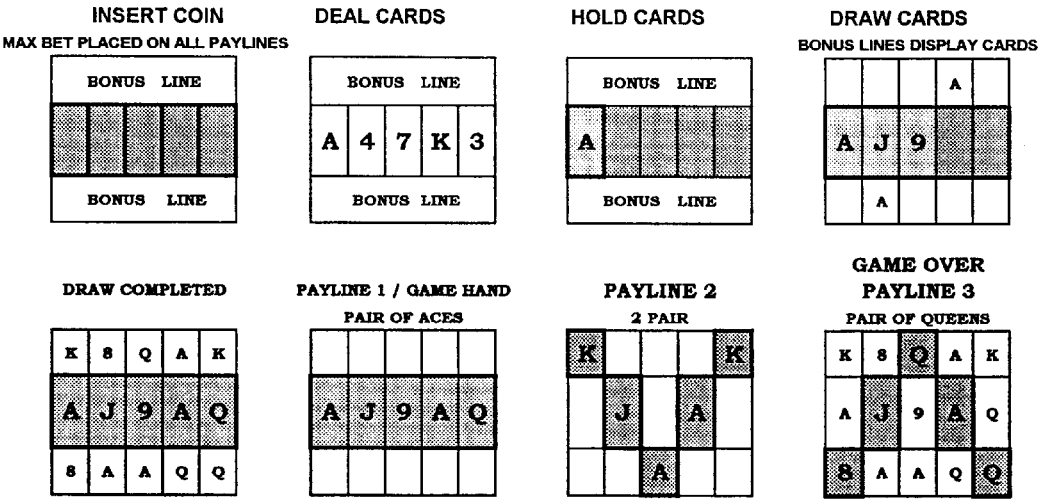
Figure 5B:
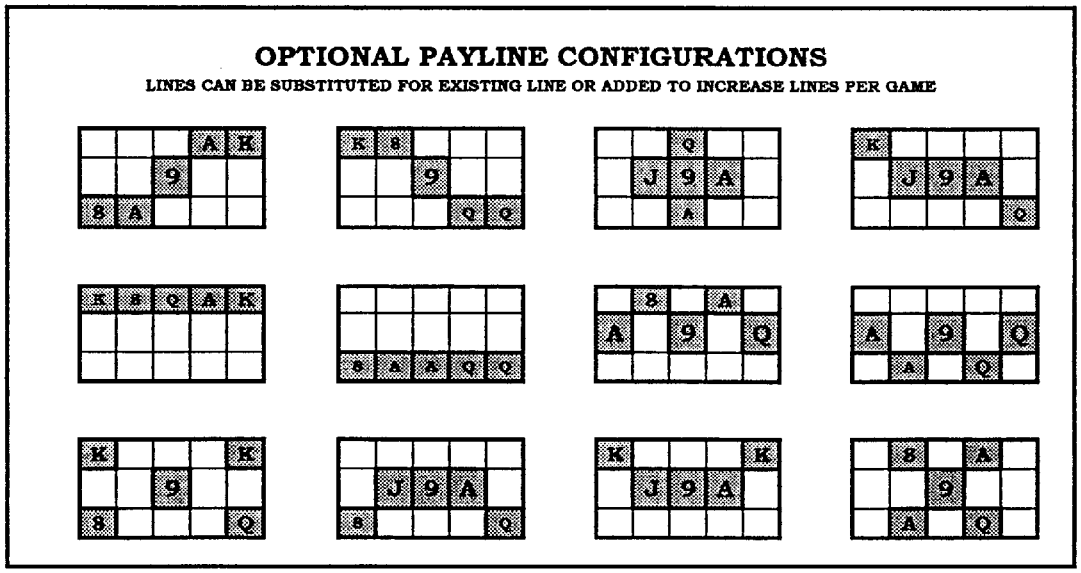
Figure 5C:
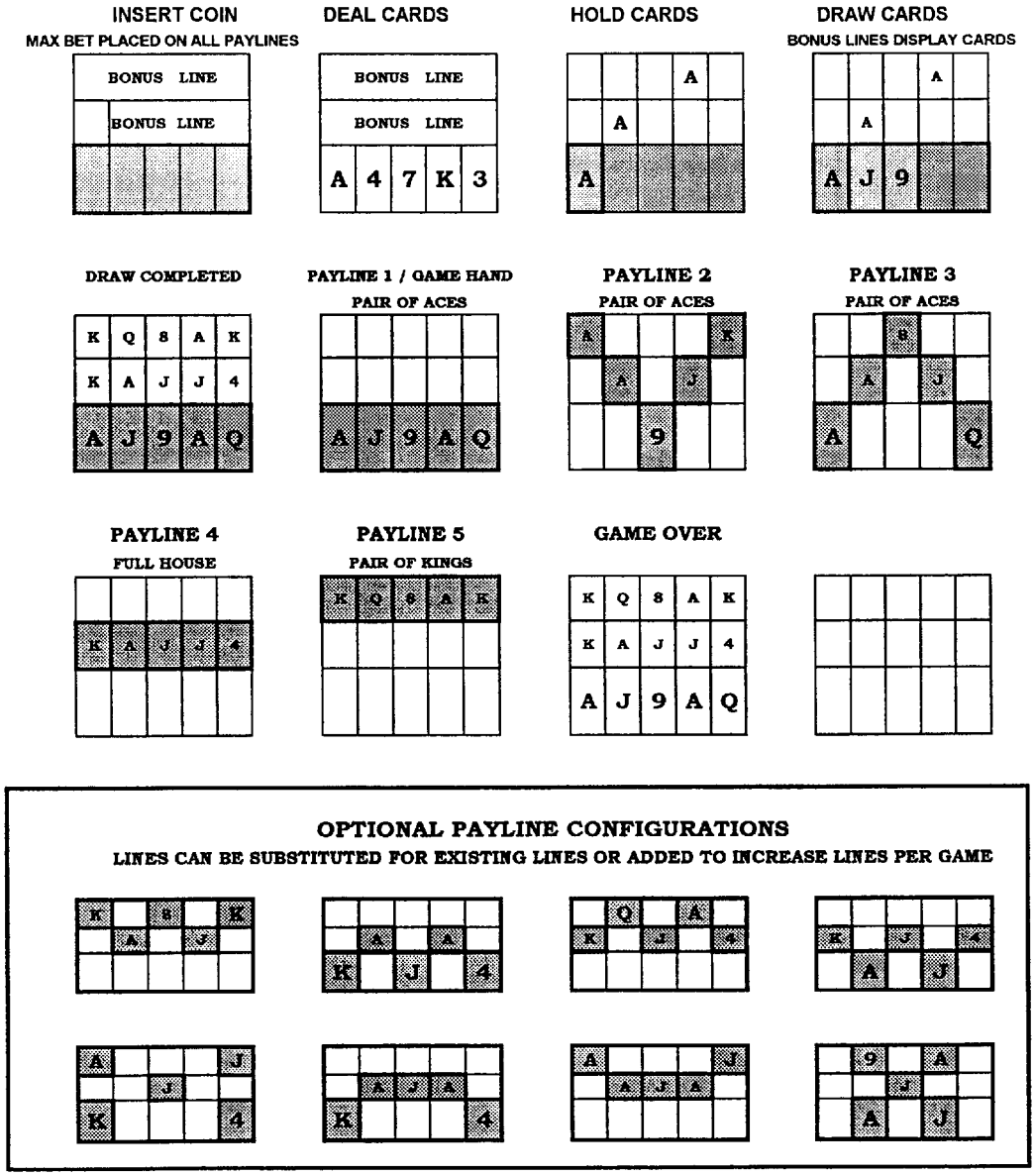
Figure 5D:
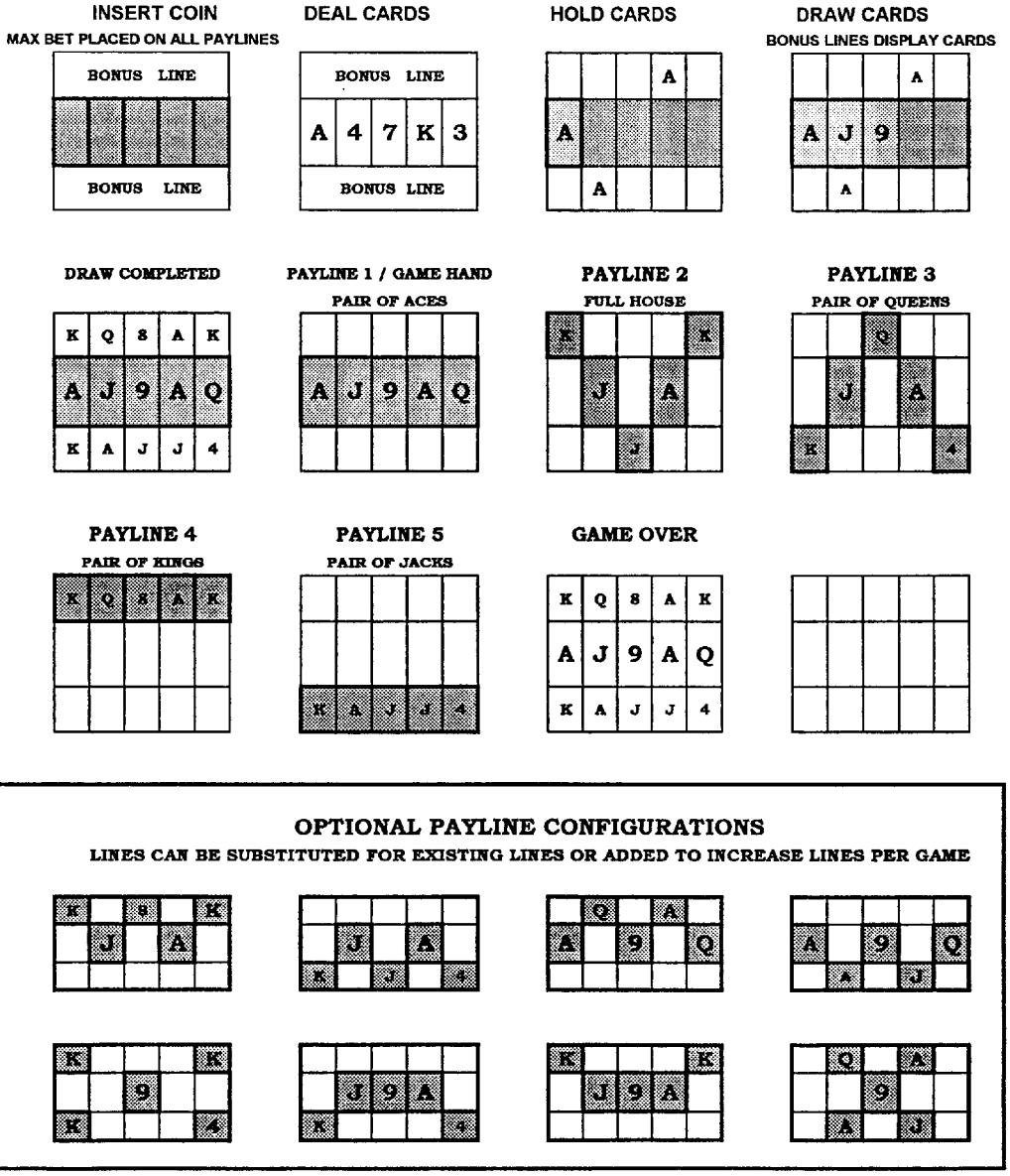

The sequence of operations performed as illustrated within FIG. 5*a* 5101–5113 correspond to the sequence operation in FIG. 3*a* 3101–3113 with the exception of operations 5107–5108. In these operations, only the cards held from the game hand are duplicated within the bonus lines. The remaining positions win the bonus lines are filled from cards randomly selected from the deck of cards used in the game after the cards drawn to fill the discarded positions in the game hand. As above, FIG. 5*a* is 3-payline game using a 3×5 array using a bottom row position for the game hand. FIG. 5*b* is 3-payline game using a 3×5 array using a center row position for the game hand. FIG. 5*c* is 5-payline game using a 3×5 array using a bottom row position for the game hand. FIG. 5*d* is 5-payline game using a 3×5 array using a bottom row position for the game hand. FIG. 5*e* is 12-payline game using a 5×5 array using a bottom row position for the game hand. FIG. 5*f* is 12-payline game using a 5×5 array using a bottom row position for the game hand.

Figure 6:
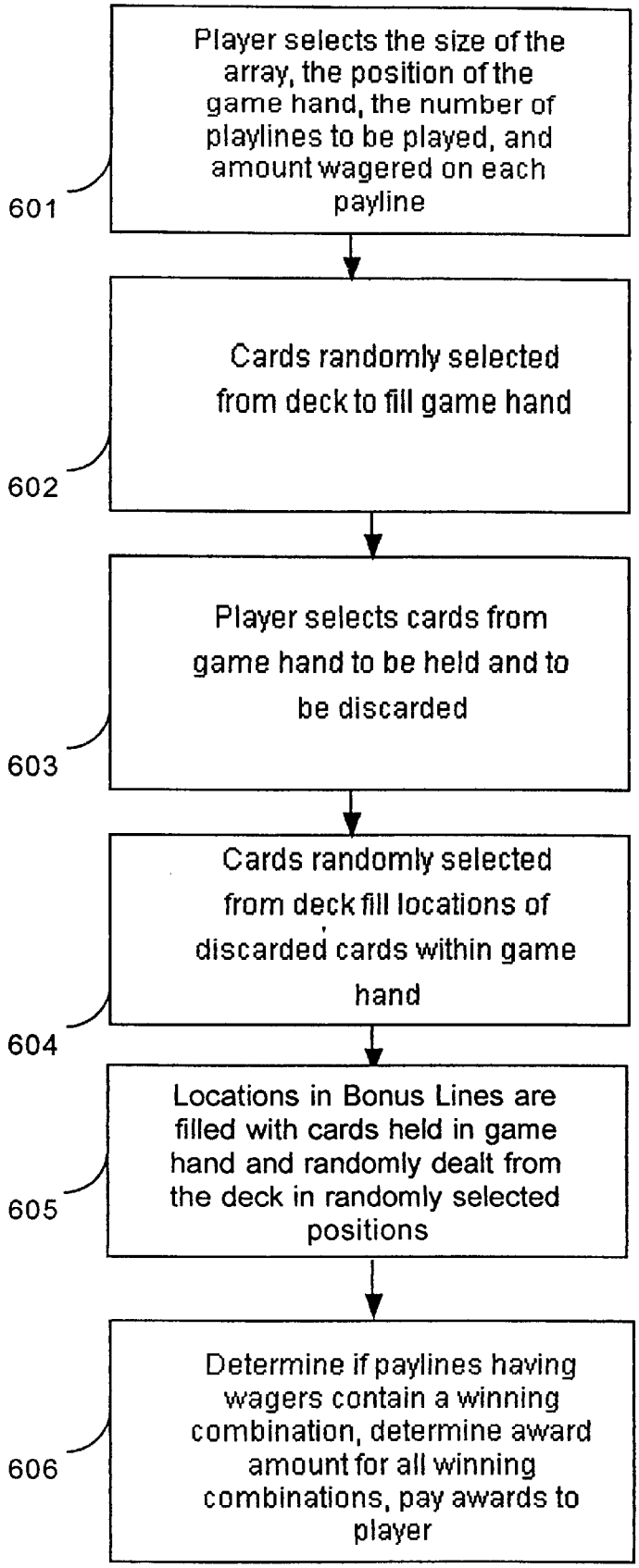
FIG. 6 illustrates a logical operational flow diagram for the operations performed by the computer-based video gaming device according to the second exemplary embodiment of the present invention.
Figure 7A:
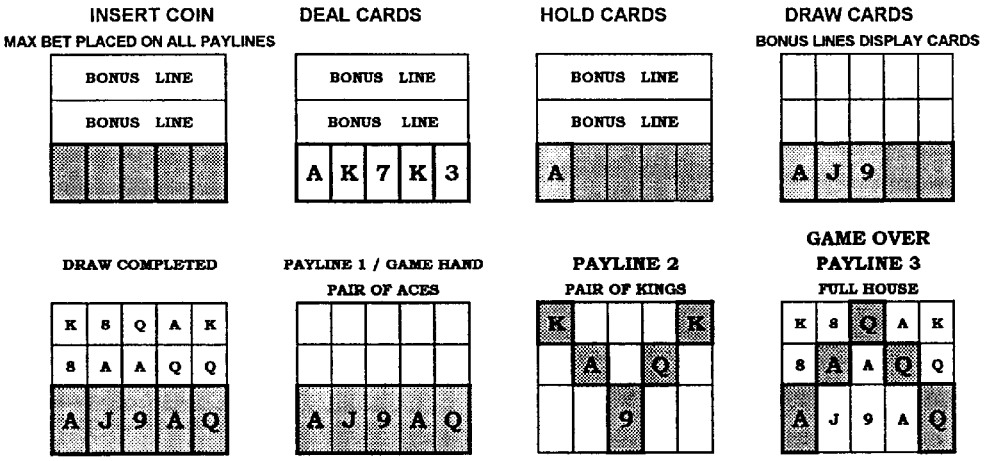
Figure 7A:
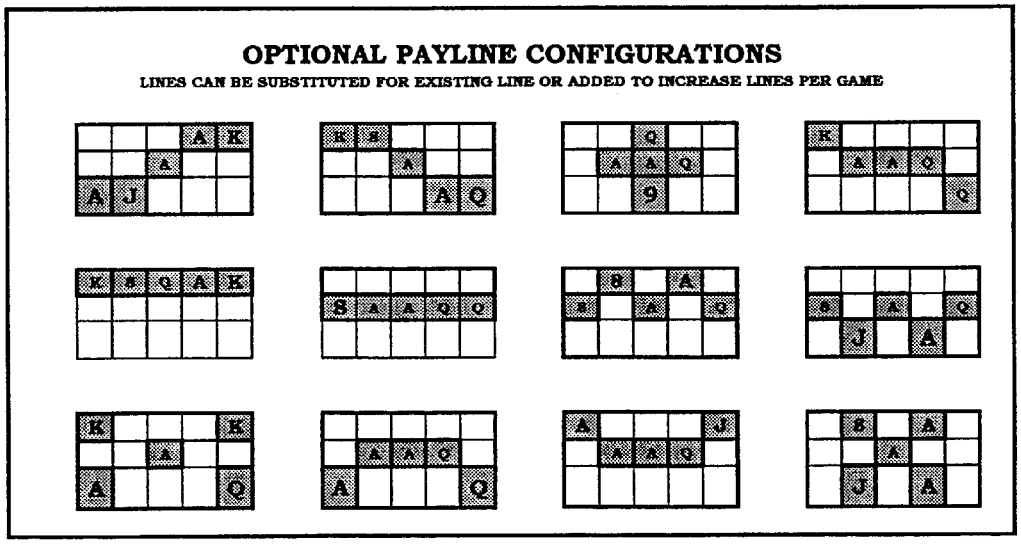
Figure 7B:
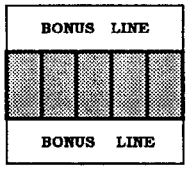
Figure 7B:
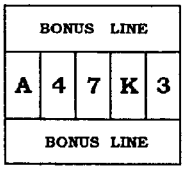
Figure 7B:
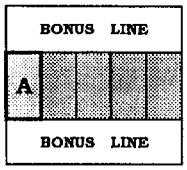
Figure 7B:
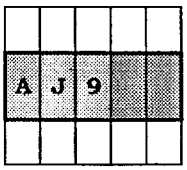
Figure 7B:
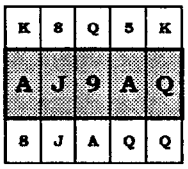
Figure 7B:
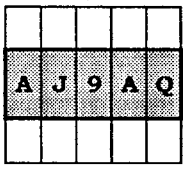
Figure 7B:
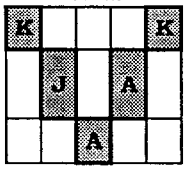
Figure 7B:
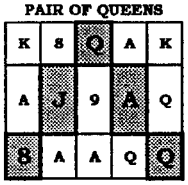
Figure 7B:
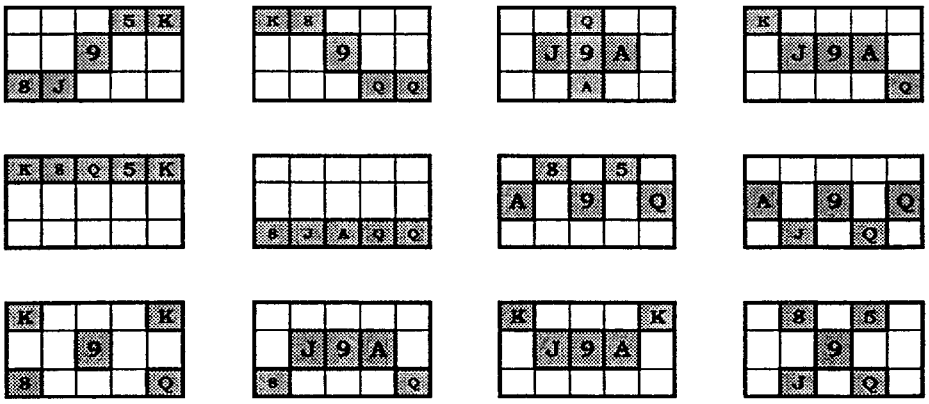
Figure 7C:
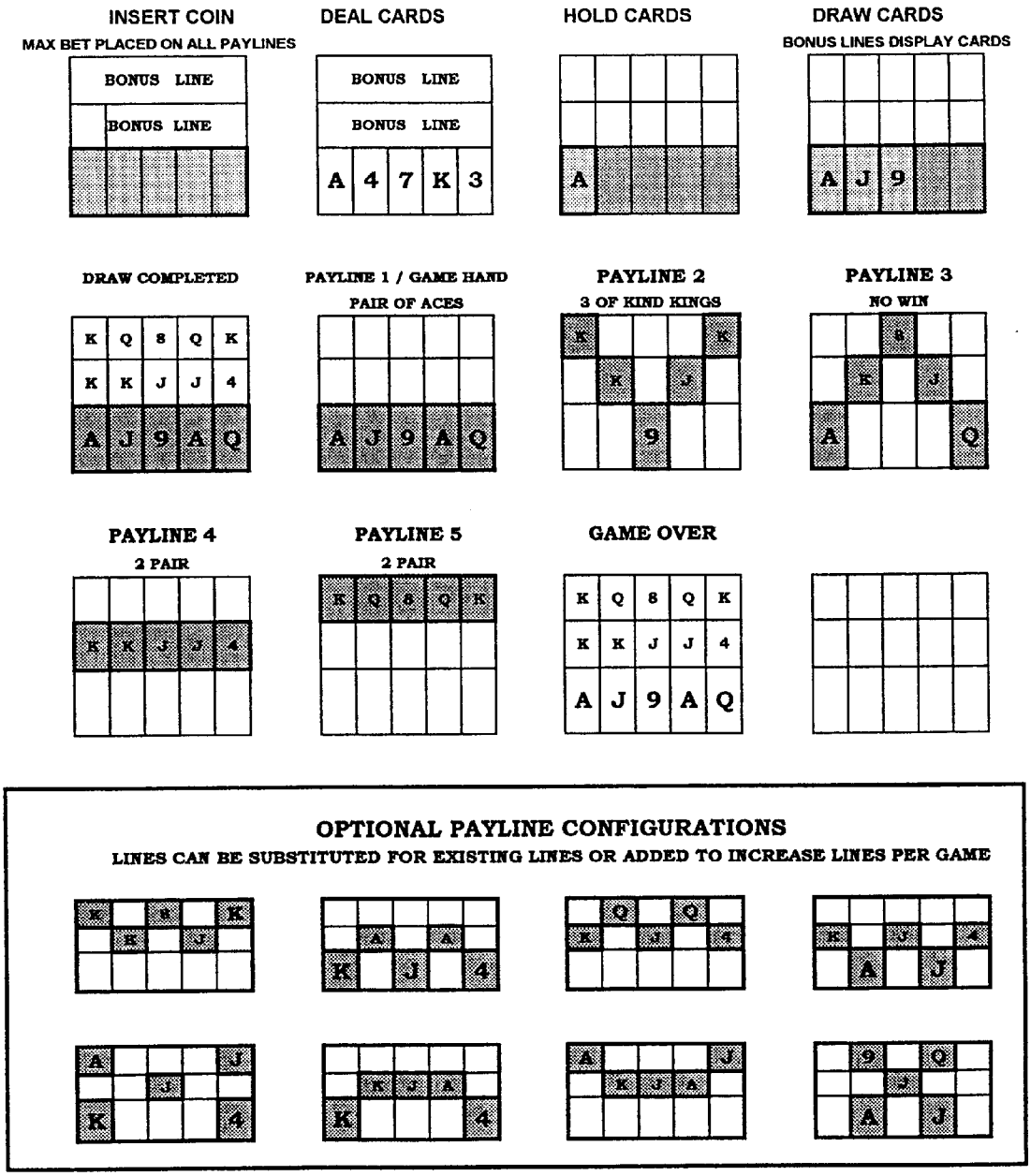
Figure 7D:
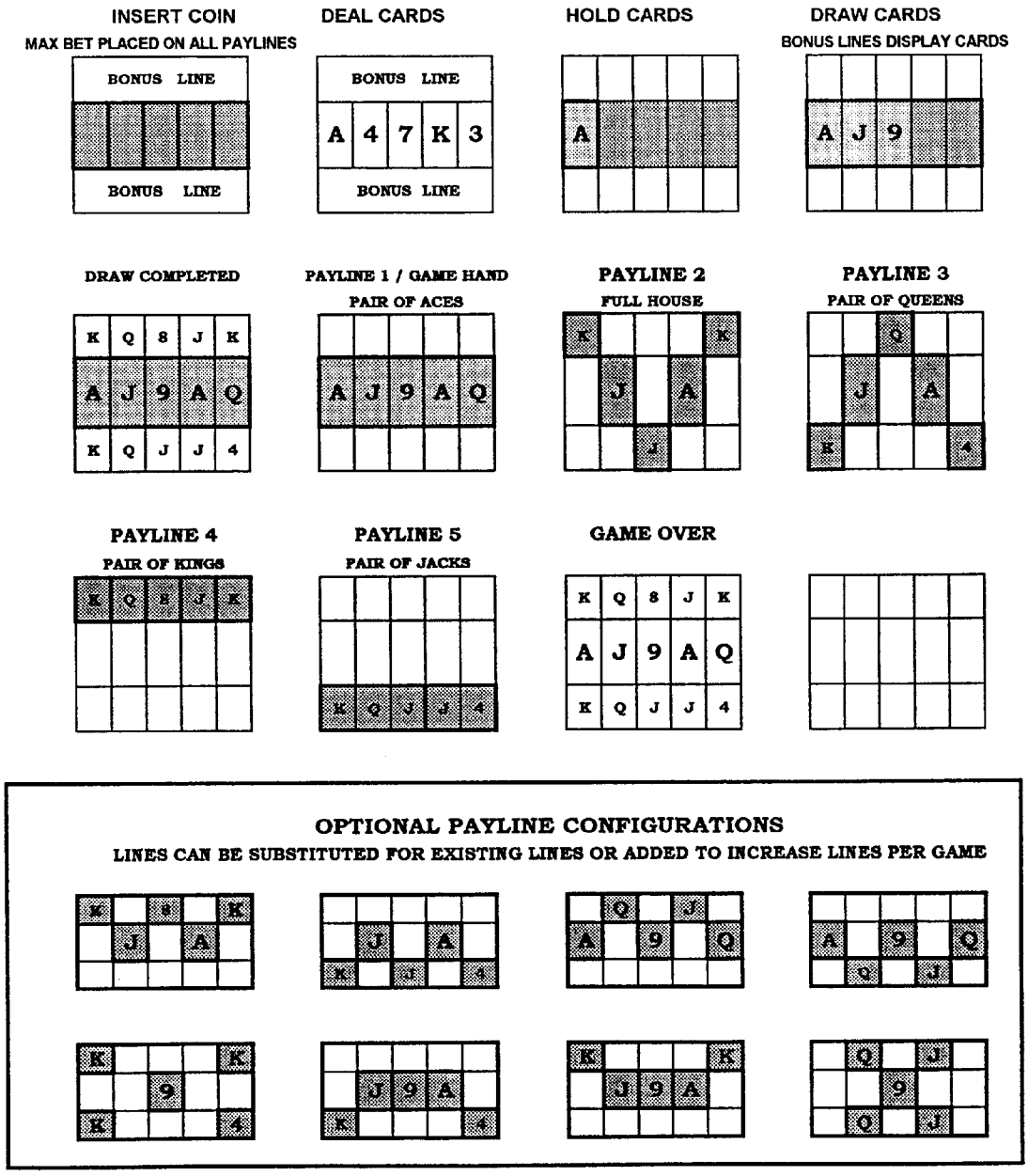
Figure 7F:
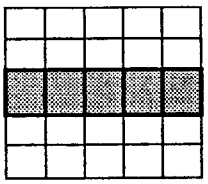
Figure 7F:
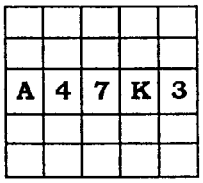
Figure 7F:
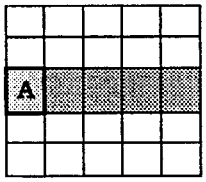
Figure 7F:
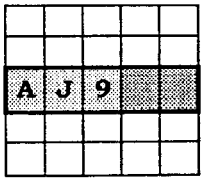
Figure 7F:
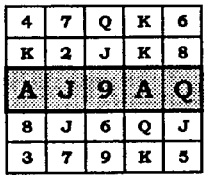
Figure 7F:
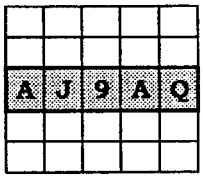
Figure 7F:
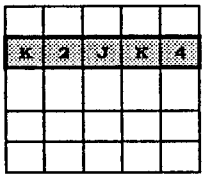
Figure 7F:
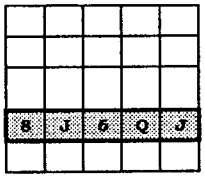
Figure 7F:
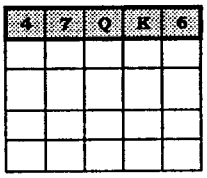
Figure 7F:
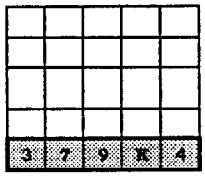
Figure 7F:
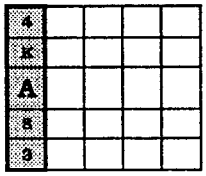
Figure 7F:
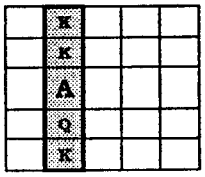
Figure 7F:
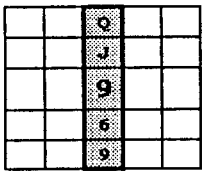
Figure 7F:
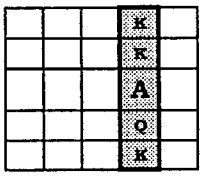
Figure 7F:
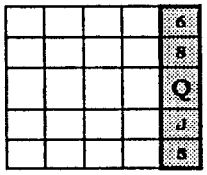
Figure 7F:
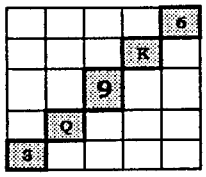
Figure 7F:
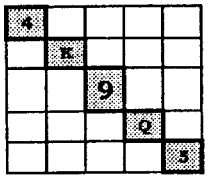
Figure 7F:
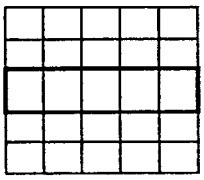
Figure 7F:
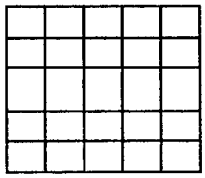
Figure 7F:
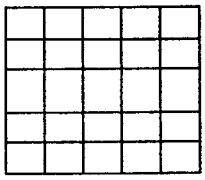

FIG. 6 illustrates a logical operational flow diagram for the operations performed by the computer-based video gaming device according to the second exemplary embodiment of the present invention. The game begins with the player selecting a set of game parameters used to control the operation of the game in operation 601. These parameters include the size of the array, the number of paylines to be played, the amount wagered on each selected payline, and the row position for the game hand within the array. These parameters may be selected from a set of default values, may be selected from the values used by the player in a previous hand of the game, and selected from input received from the player.

Once the game parameters are selected, the game hand is filled with a set of randomly dealt cards from a standard deck of playing cards in operation 602. The player responds to these cards in the game hand by selecting the cards within the game hand to be held for continued use in the game and the cards to be discarded from future use in the game in operation 603.

The game proceeds to operation 604 after the desired cards have been discarded where the locations of these discarded cards are filled with additional cards randomly dealt from the same deck of cards. Either at the same time that the location of these discarded cards are filled with new cards, or after the location of the discarded cards are filled, the cards that were held in the game hand are duplicated and randomly placed within locations of the bonus lines in the game array. Each card held in the game hand is duplicated the same number of times in operation 605. The remaining locations within the bonus lines are filled in operation 605 using cards randomly dealt from the same deck of cards used in the prior operations.

The game concludes after operation 606 in which all of the paylines in which a player places a wager are checked to determine if a winning poker hand combination is present. For each winning combination found, an award amount to be paid to the player is determined based upon the wager placed upon the payline and the specific wiling combination found. The total award from all paylines wagered is paid to the player. This payout may be in the form of coins or tokens returned to the player using the hopper. The payout may also be in the form of monetary credits applied to a total maintained by the gaming device until the player indicates that he or she is finished playing the gaming device.

FIGS. 7*a–f* illustrate a series of game sequence illustrations for multi-line poker played according to a third exemplary embodiment of the present invention. The third exemplary embodiment differs from the first and second exemplary embodiments by not utilizing any of the "game hand" cards for display in the additional bonus display lines. The "game hand" is displayed, and the hold and new draw routine is completed. Then additional draw only cards are selected from the original deck and displayed on the bonus display lines. After the lines are filled, the pay comparison for each selected pay line is completed and the player credited.

The sequence of operations performed as illustrated within FIG. 7*a* 7101–7113 correspond to the sequence operation in FIG. 3*a* 3101–3113 with the exception of operations 7107–7108. In these operations, no cards held from the game hand are duplicated within the bonus lines. All of the positions within the bonus lines are filled from cards randomly selected from the deck of cards used in the game after the cards drawn to fill the discarded positions in the game hand. As above, FIG. 5*a* is 3-payline game using a 3×5 array using a bottom row position for the game hand. FIG. 5*b* is 3-payline game using a 3×5 array using a center row position for the game hand. FIG. 5*c* is 5-payline game using a 3×5 array using a bottom row position for the game hand. FIG. 5*d* is 5-payline game using a 3×5 array using a bottom row position for the game hand. FIG. 5*e* is 12-payline game using a 5×5 array using a bottom row position for the game hand. FIG. 5*f* is 12-payline game using a 5×5 array using a bottom row position for the game hand.

Figure 8:
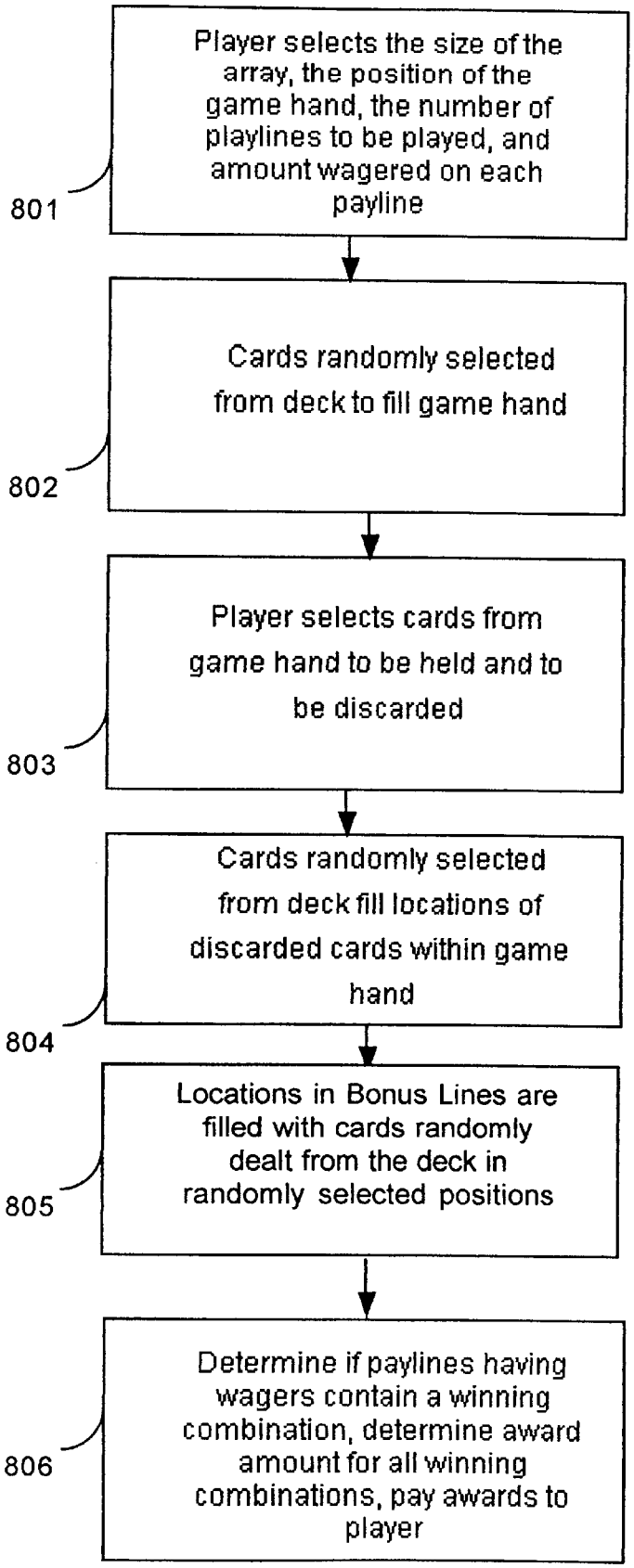
FIG. 8 illustrates a logical operational flow diagram for the operations performed by the computer-based video gaming device according to the third exemplary embodiment of the present invention.

FIG. 8 illustrates a logical operational flow diagram for the operations performed by the computer-based video gaming device according to the first exemplary embodiment of the present invention. The game begins with the player selecting a set of game parameters used to control the operation of the game in operation 801. These parameters include the size of the array, the number of paylines to be played, the amount wagered on each selected payline, and the row position for the game hand within the array. These parameters may be selected from a set of default values, may be selected from the values used by the player in a previous hand of the game, and selected from input received from the player.

Once the game parameters are selected, the game hand is filled with a set of randomly dealt cards from a standard deck of playing cards in operation 802. The player responds to these cards in the game hand by selecting the cards within the game hand to be held for continued use in the game and the cards to be discarded from future use in the game in operation 803.

The game proceeds to operation 804 after the desired cards have been discarded where the locations of these discarded cards are filled with additional cards randomly dealt from the same deck of cards. Either at the same time that the location of these discarded cards are filled with new cards, or after the location of the discarded cards are filled, the locations of the bonus lines in the game array are filled with additional cards randomly dealt from the same deck of cards used above in operation 805.

The game concludes after operation 806 in which all of the paylines in which a player places a wager are checked to determine if a wining poker hand combination is present. For each winning combination found, an award amount to be paid to the player is determined based upon the wager placed upon the payline and the specific winning combination found. The total award from all paylines wagered is paid to the player. This payout may be in the form of coins or tokens returned to the player using the hopper. The payout may also be in the form of monetary credits applied to a total maintained by the gaming device until the player indicates that he or she is finished playing the gaming device.

In all of the above embodiments the payline selection is accomplished by the player initially, placing a bet on the original game hand and then betting on each one of the desired paylines. The paylines can range from 3 to 12 lines depending on the game configuration. The amount of bets acceptable per line varies as well, depending on each game configuration. Any amount from one to five hundred coins per line is acceptable for this game, again with respect to the actual game configuration. The game will accept the first coin or credit bet on the game hand. If the player wants to increase the bet on the game hand, a single coin/credit bet must be made on each of the additional available paylines configured for that specific game. Therefore, a Multi-line poker with 3 lines including the game hand, must receive a single coin/credit bet on each line (3 total) to begin to bet a second coin/credit on the game hand. If this particular game is a max 5 coin/credit bet per line, then a total of 15 coins/credit must be bet to select 5 total on the game hand. This results in 5 total coin/credit bets on each pay line.

Tables 1 and 2 below illustrate example award payouts that may be paid for various winning poker hand combinations contained within paylines in which a player has placed a wager. In Table 1, a 3 payline award schedule is illustrated. The award schedule provides a first set of awards for the game hand payline and a separate set of awards for the payline 2 and payline 3 as discussed above. The awards may also be based upon the amount wagered on the paylines.

TABLE 1

| | GAME HAND/LINE 1 | | LINES 2 & 3 | |
|---|---|---|---|---|
| AWARDS | 1 COIN | MAX COIN | 1 COIN | MAX COIN |
| Royal St. Flush | 250 | 4000 | 250 | 4000 |
| St. Flush | 50 | 250 | 50 | 250 |
| 5 of a Kind | | | 25 | 125 |
| 4 of a Kind | 25 | 125 | 10 | 50 |
| Full House | 9 | 45 | 9 | 45 |
| Flush | 6 | 30 | 5 | 25 |
| Straight | 4 | 20 | 4 | 20 |
| Three of a Kind | 3 | 15 | 2 | 10 |
| Two Pair | 2 | 10 | 1 | 5 |
| Pair Jacks or Better | 1 | 5 | | |

Table 2 illustrates an award schedule that is the same for all paylines played within a game. Once again, the amount wagered on the payline is used to determine the appropriate award schedule used for a payline having a winning poker combination.

TABLE 2

| AWARDS FOR ALL LINES | 1 COIN | MAX COIN |
|---|---|---|
| 5 of a Kind Aces | 500 | Jackpot |
| Royal Flush | 250 | 4000 |
| St. Flush | 50 | 250 |
| 5 of a Kind | 25 | 125 |
| 4 of a Kind | 20 | 100 |
| Full House | 9 | 45 |
| Flush | 5 | 25 |
| Straight | 4 | 20 |
| 3 of a Kind | 2 | 10 |
| 2 Pair | 1 | 5 |
| Pair of J.O.B. | | |

Figure 9A:
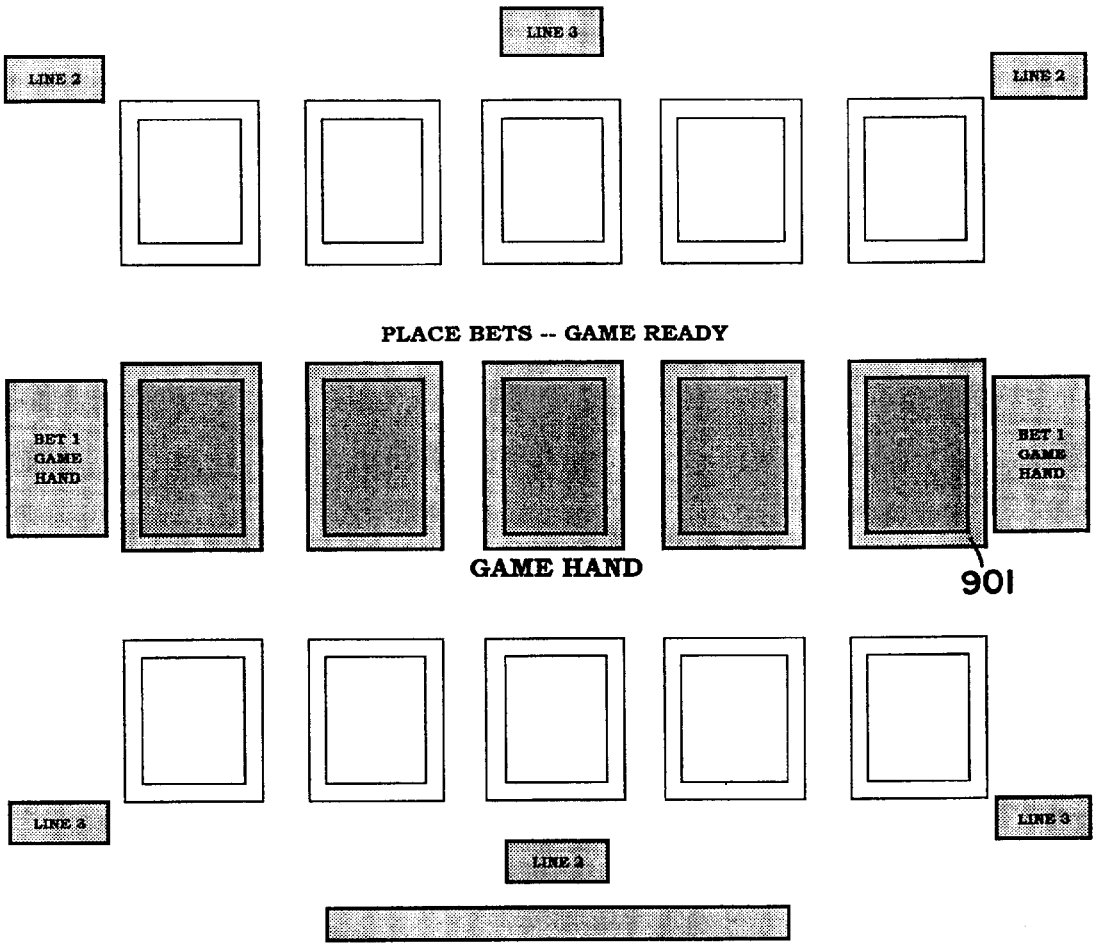
FIGS. 9*a–h* illustrate a series of game sequence illustrations for multi-line poker played according to a 3-line exemplary embodiment of the present invention.
Figure 9B:
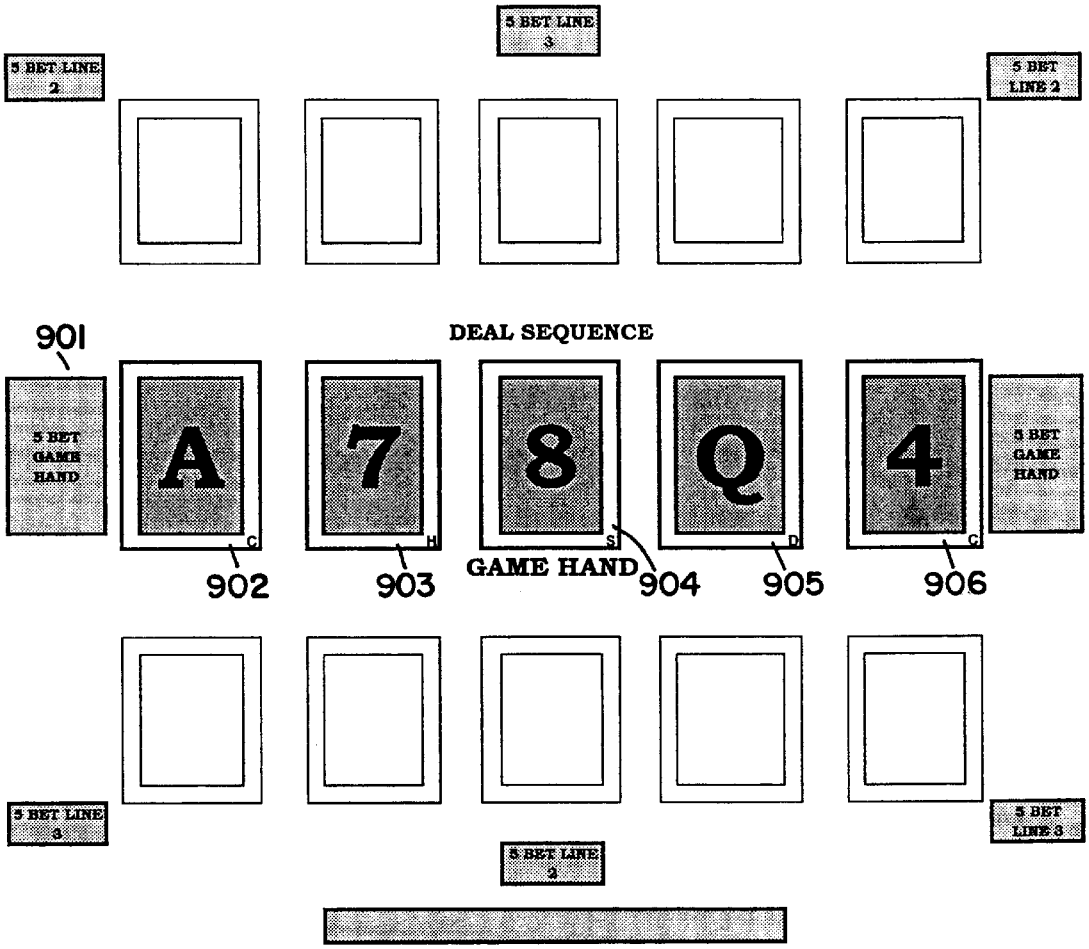
Figure 9C:
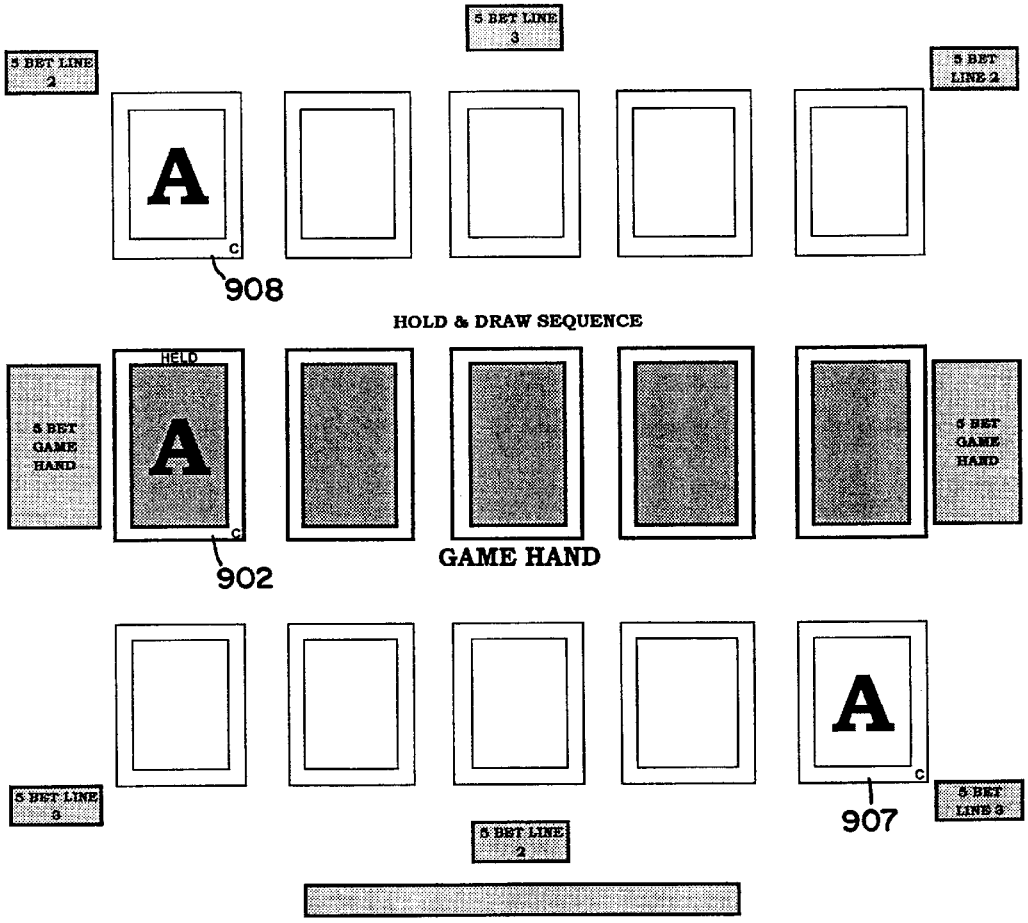

FIGS. 9*a–h* illustrate a series of game sequence illustrations for multi-line poker played according to a 3-line exemplary embodiment of the present invention. This particular example of the game uses a 3×3 array and a center row position 901 for the game hand, FIG. 9*a* illustrates the screen image for the game once the player selects game parameters and begins the game. In FIG. 9*b*, the game hand 901 is filled with an "A" 902, a "7" 903, an "8" 904, a "Q" 905, and a"4" 906. In FIG. 9*c*, the player selects the "A" 902 to be held. The other cards in the game hand 903–906 are discarded. The "A" is also duplicated twice and place at location (1,1) 908 and location (3,5) 907.

Figure 9D:
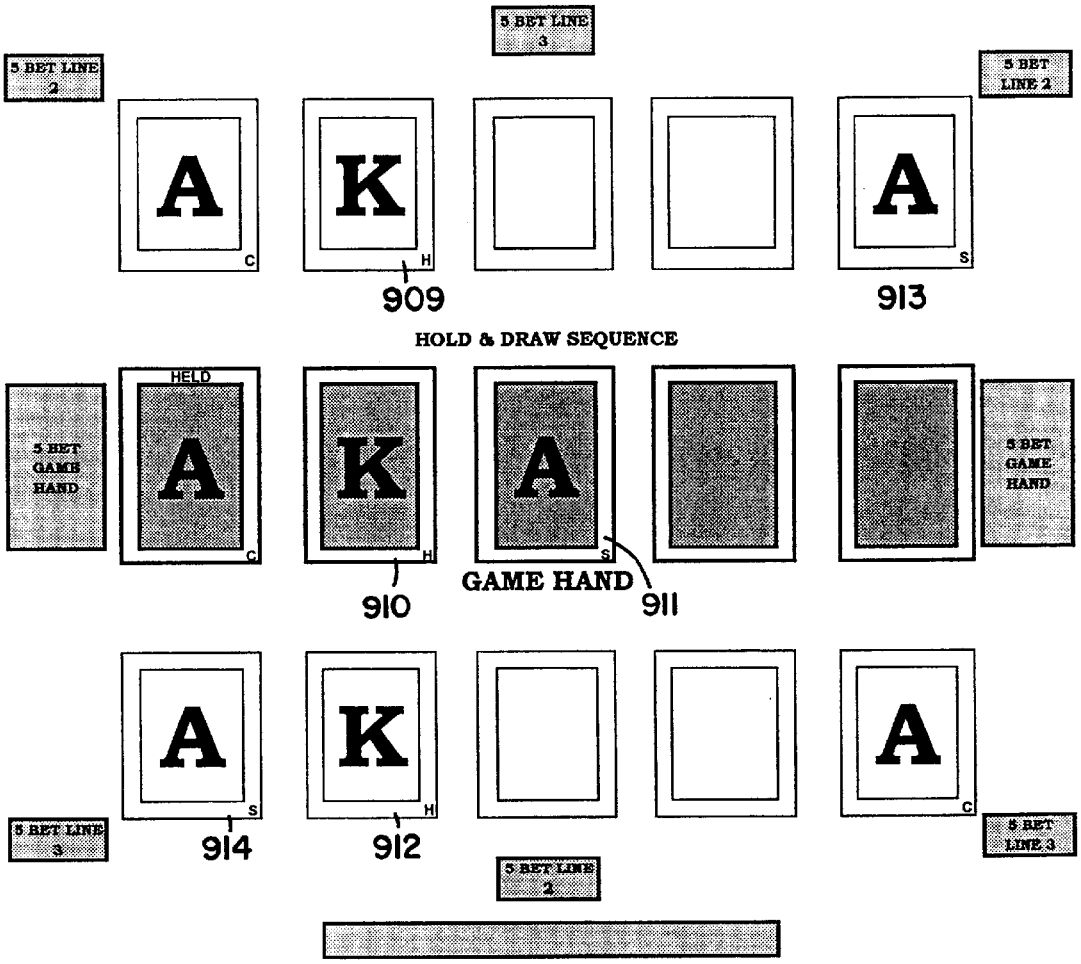
Figure 9E:
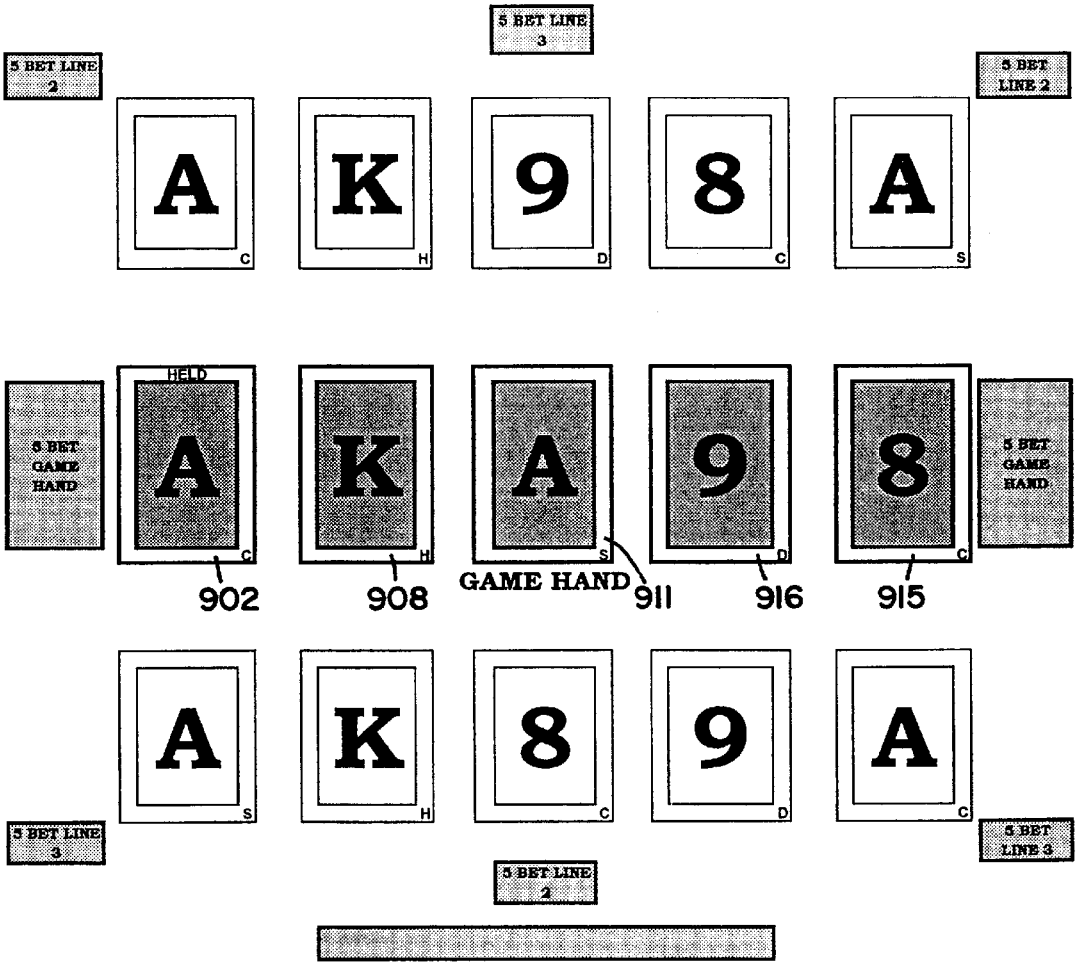

FIG. 9*d* illustrates the filling of the game array, The locations of the discarded cards are filled with cards randomly drawn from the deck. FIG. 9*d* shows a "K" 910 and a second "A" 911 in these positions within the game hand. The "K" is duplicated twice and placed within the game array at location (1,2) 909 and location (3,2) 912. The second "A" is also duplicated twice and placed within the game array at location (1,5) 913 and location (3,1) 914. The game array is completely filled in FIG. 9*e* as a "9" 916 and an "8" 915 are randomly placed in the game hand, duplicated twice and placed within the bonus lines.

Figure 9F:
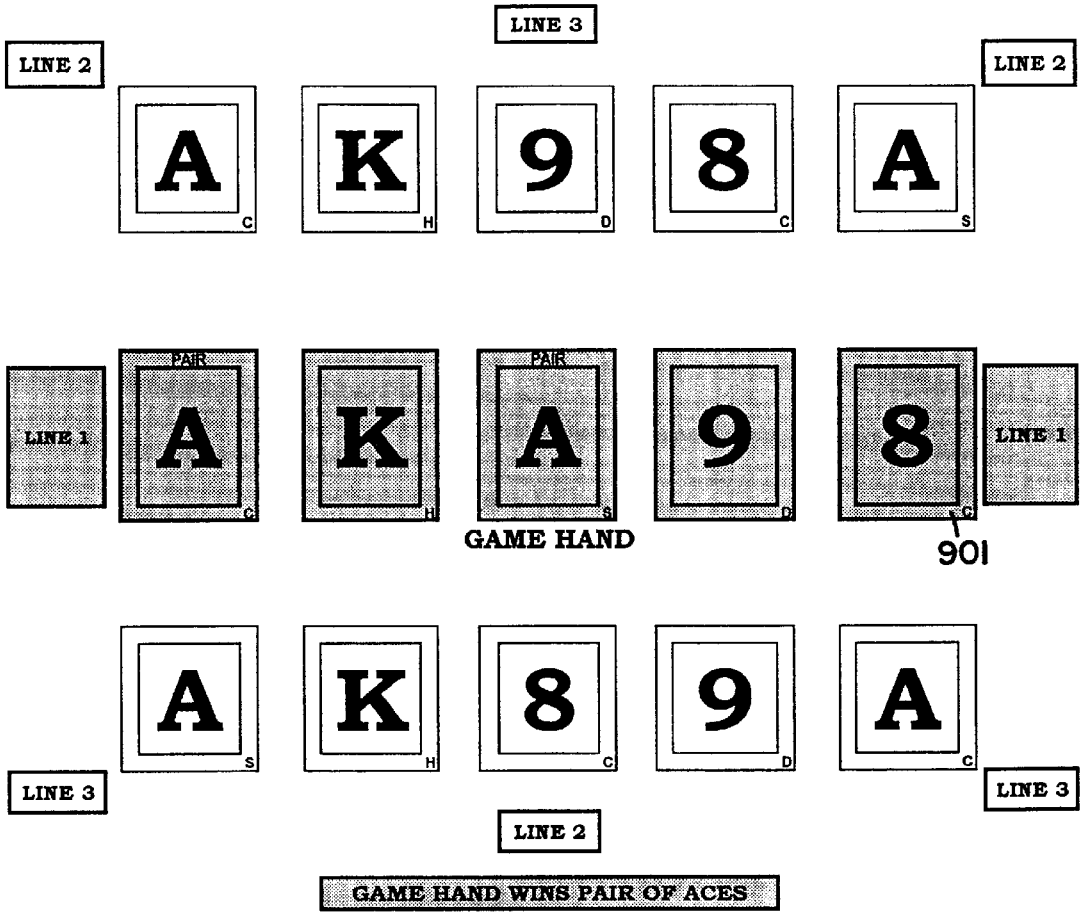
Figure 9G:
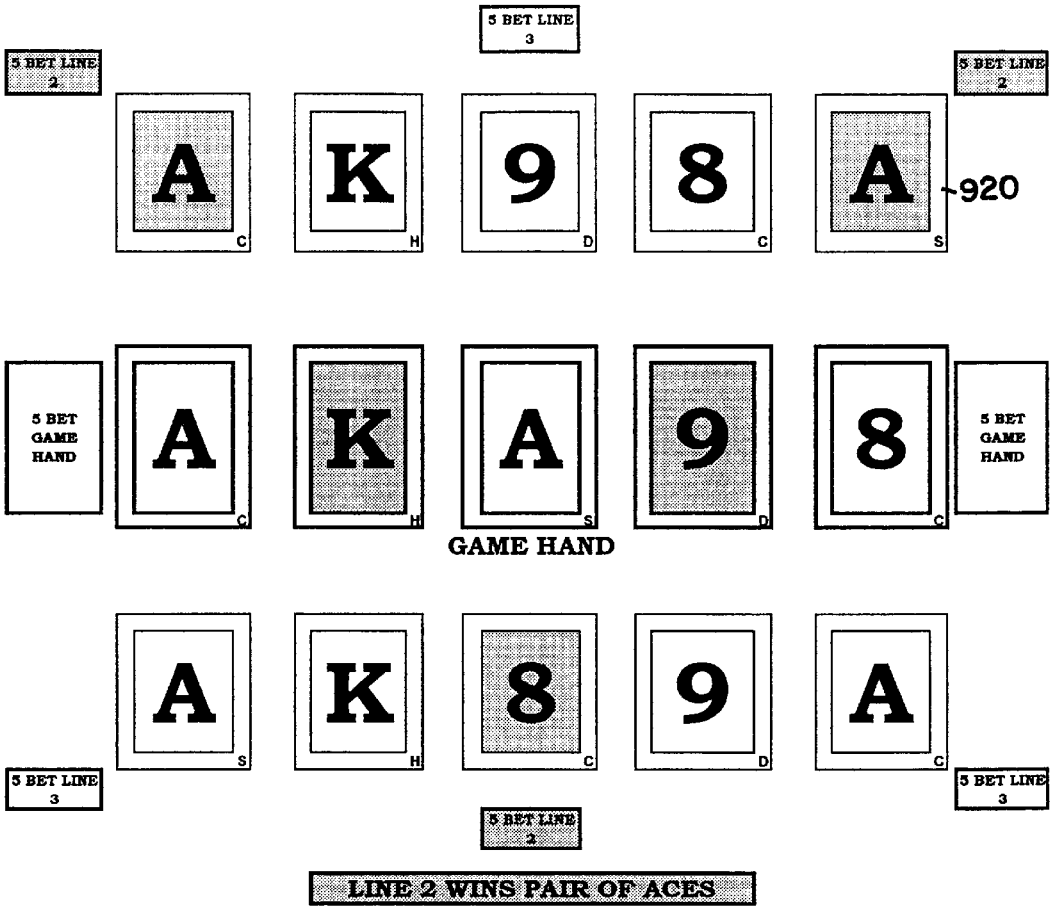
Figure 9H:
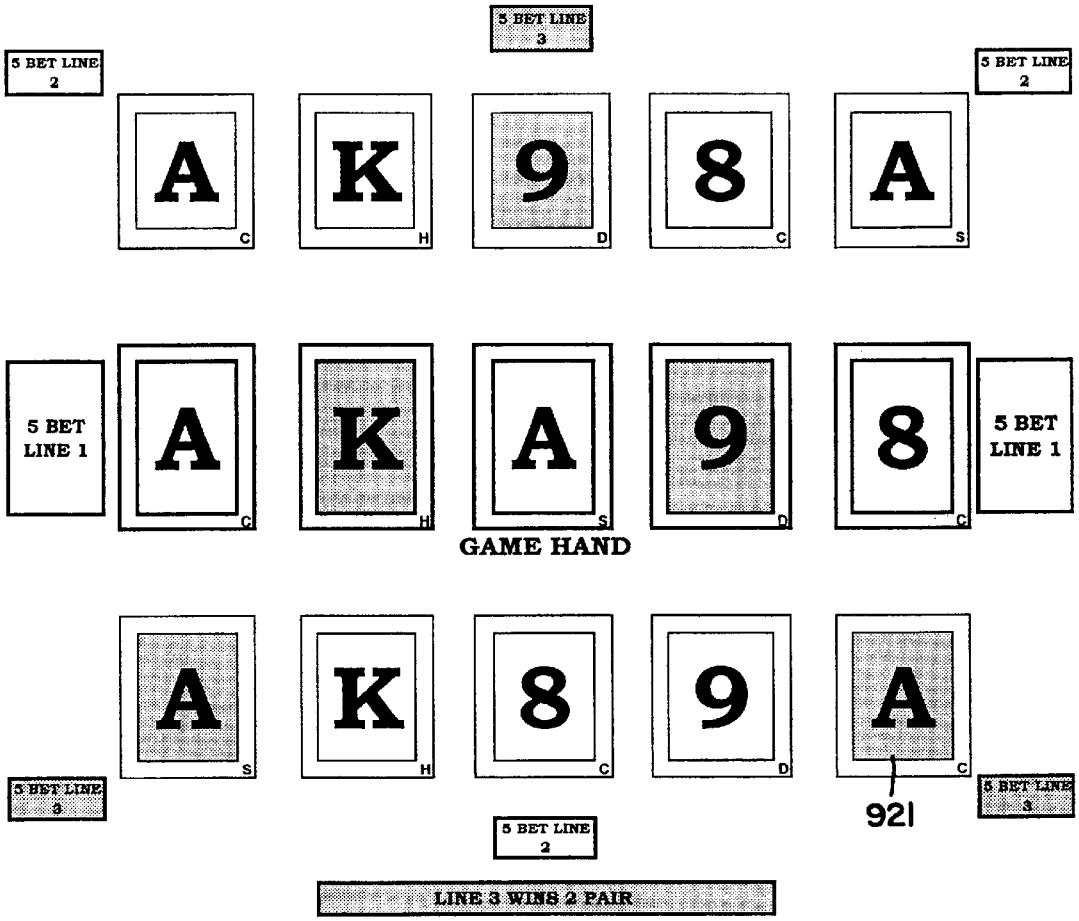

The game concludes with the game checking the game hand for a winning combination in the game hand 901 in FIG. 9*f*, in payline 2 920 in FIG. 9*g*, and in payline 3 921 in FIG. 9*h*. The total winnings from the awards corresponding to the winning combinations are returned to the player.

Figure 10A:
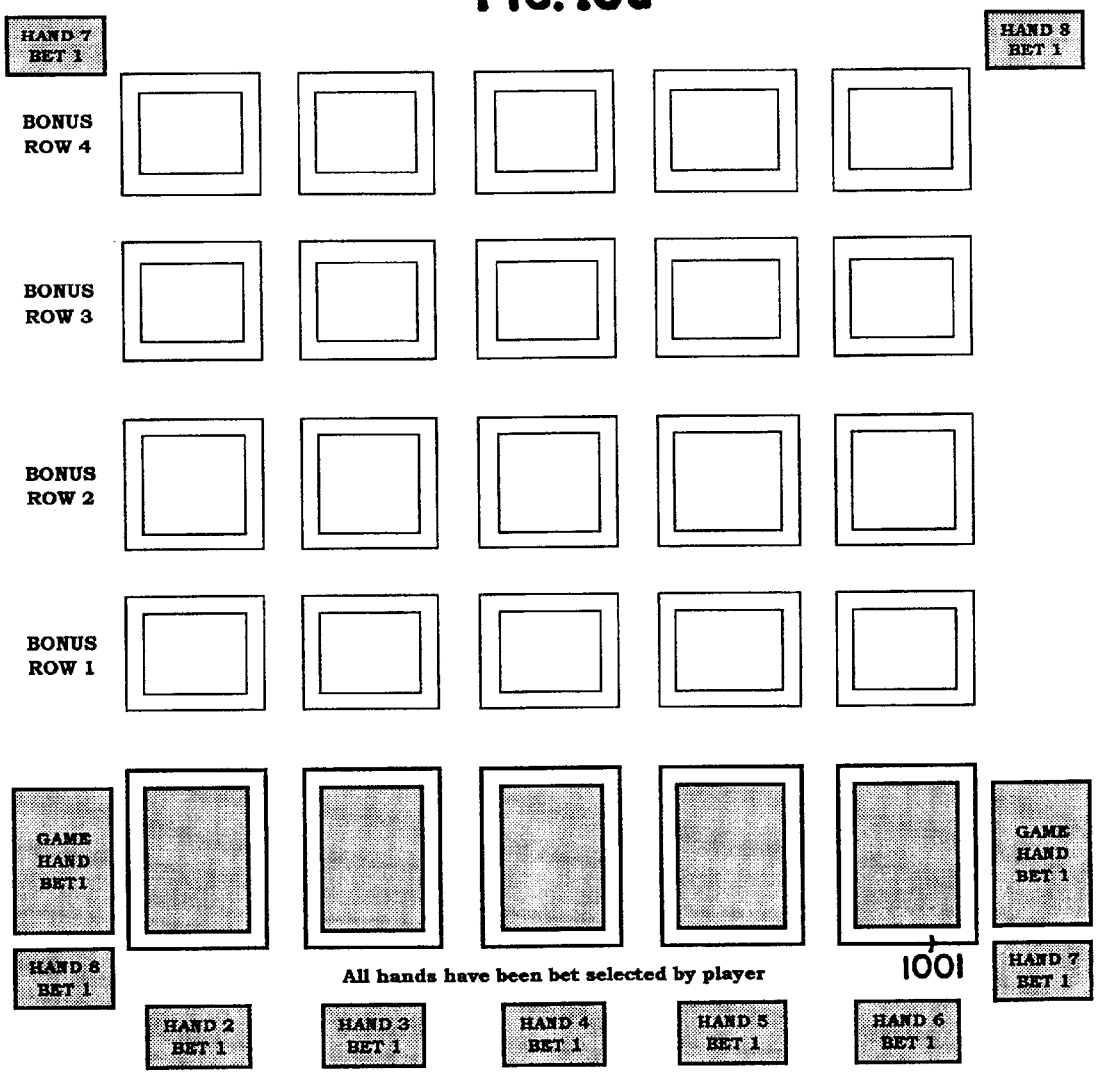
FIGS. 10*a–j* illustrate a series of game sequence illustrations for multi-line poker played according to an 8-line exemplary embodiment of the present invention.
Figure 10B:
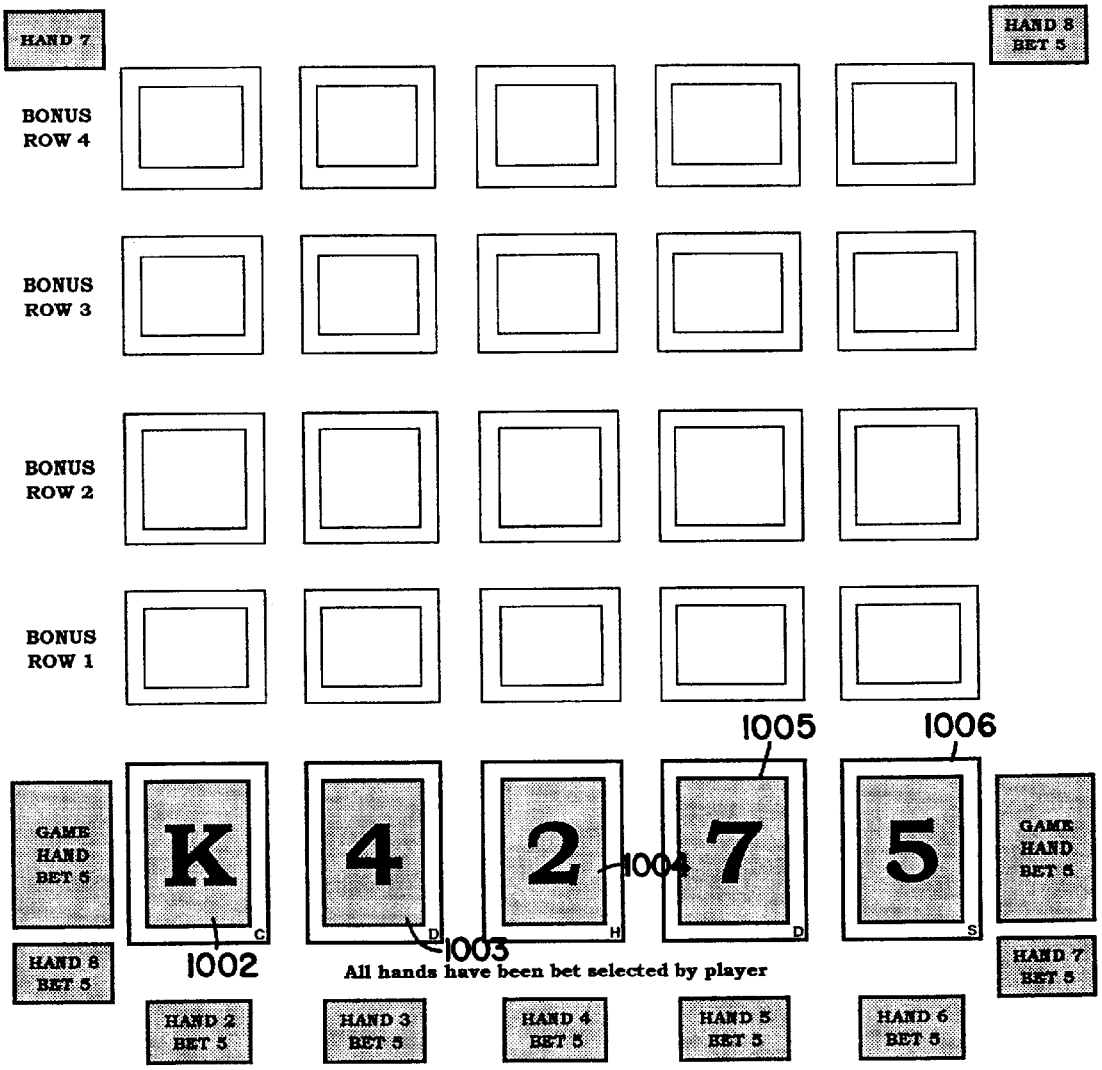
Figure 10C:
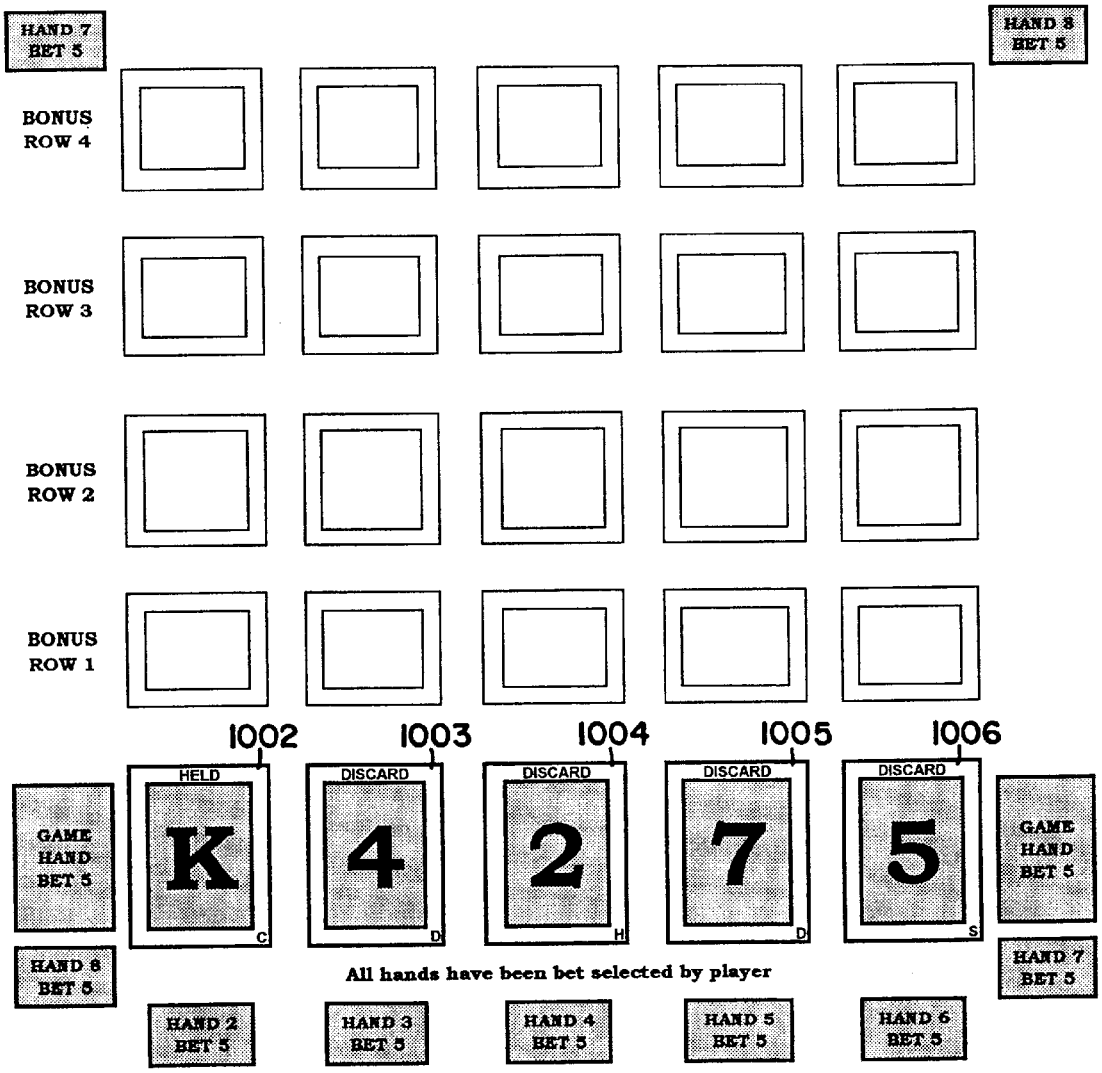
Figure 10D:
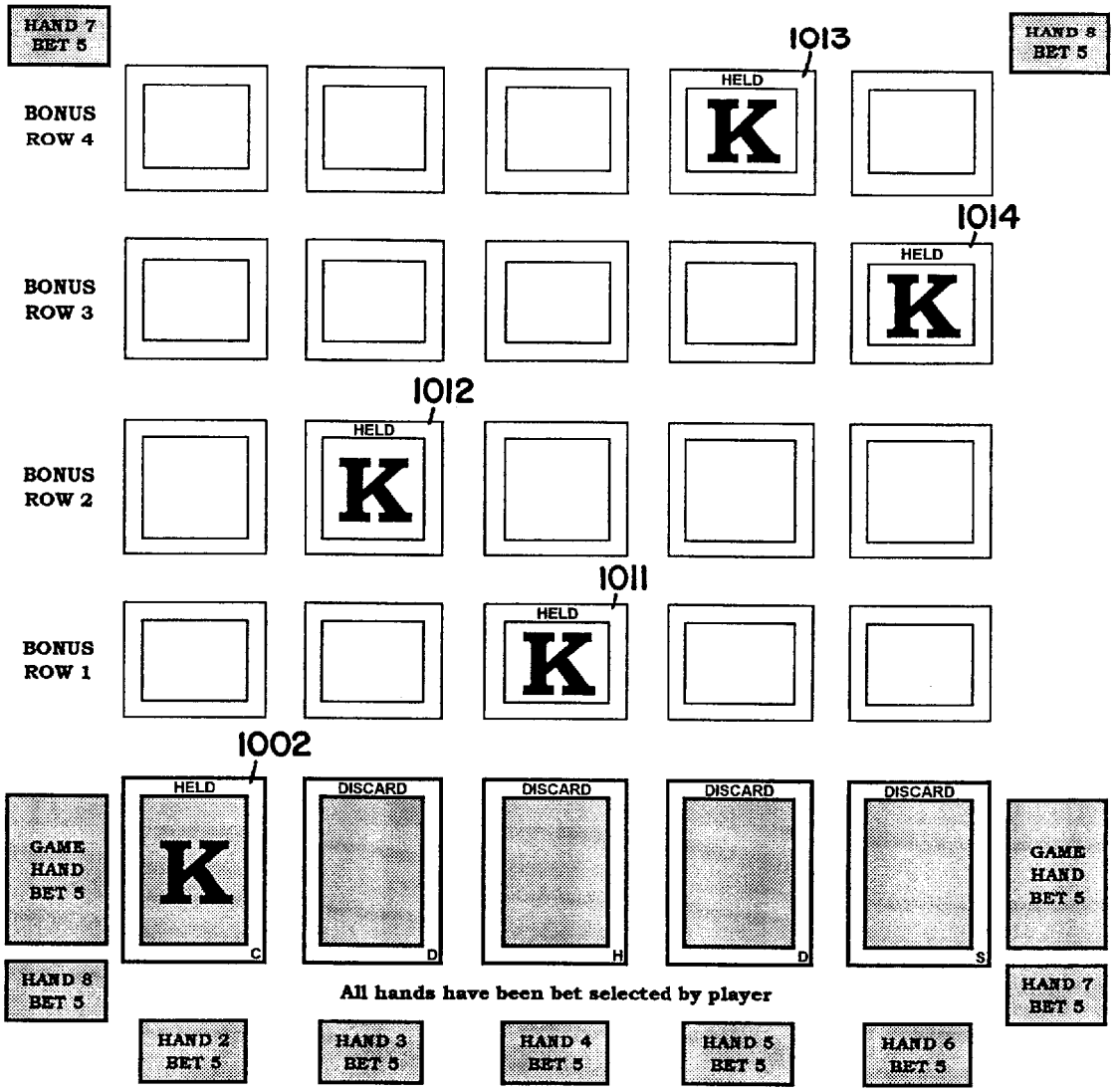

FIGS. 10*a–j* illustrate a series of game sequence illustrations for multi-line poker played according to an 8-line exemplary embodiment of the present invention. This particular example of the game uses a 5×5 array and a bottom row position 1001 for the game hand. FIG. 10*a* illustrates the screen image for the game once the player selects game parameters and begins the game. In FIG. 10*b*, the game hand 1001 is filled with an "K" 1002, a "4" 1003, an "2" 1004, a "7" 1005, and a "5" 1006. In FIG. 10*c*, the player selects the "K" 1002 to be held. The other cards in the game hand 1003–1006 are discarded. The "K" is duplicated four times and randomly place at location (4,3) 1011, location (3,2) 1012, location (2,5) 1014 and location (1,4) 1013 as shown in FIG. 10*d*.

Figure 10E:
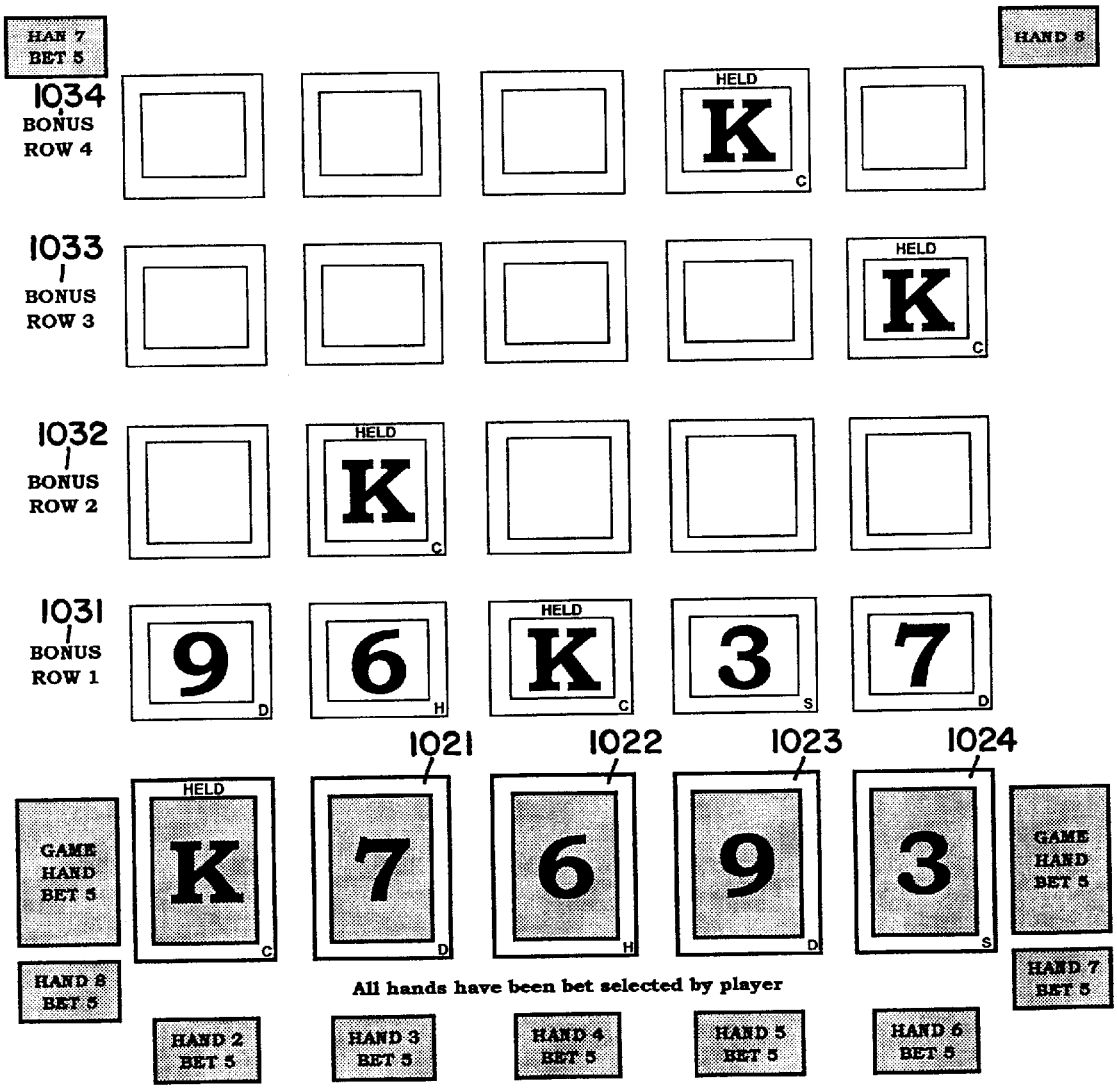
Figure 10F:
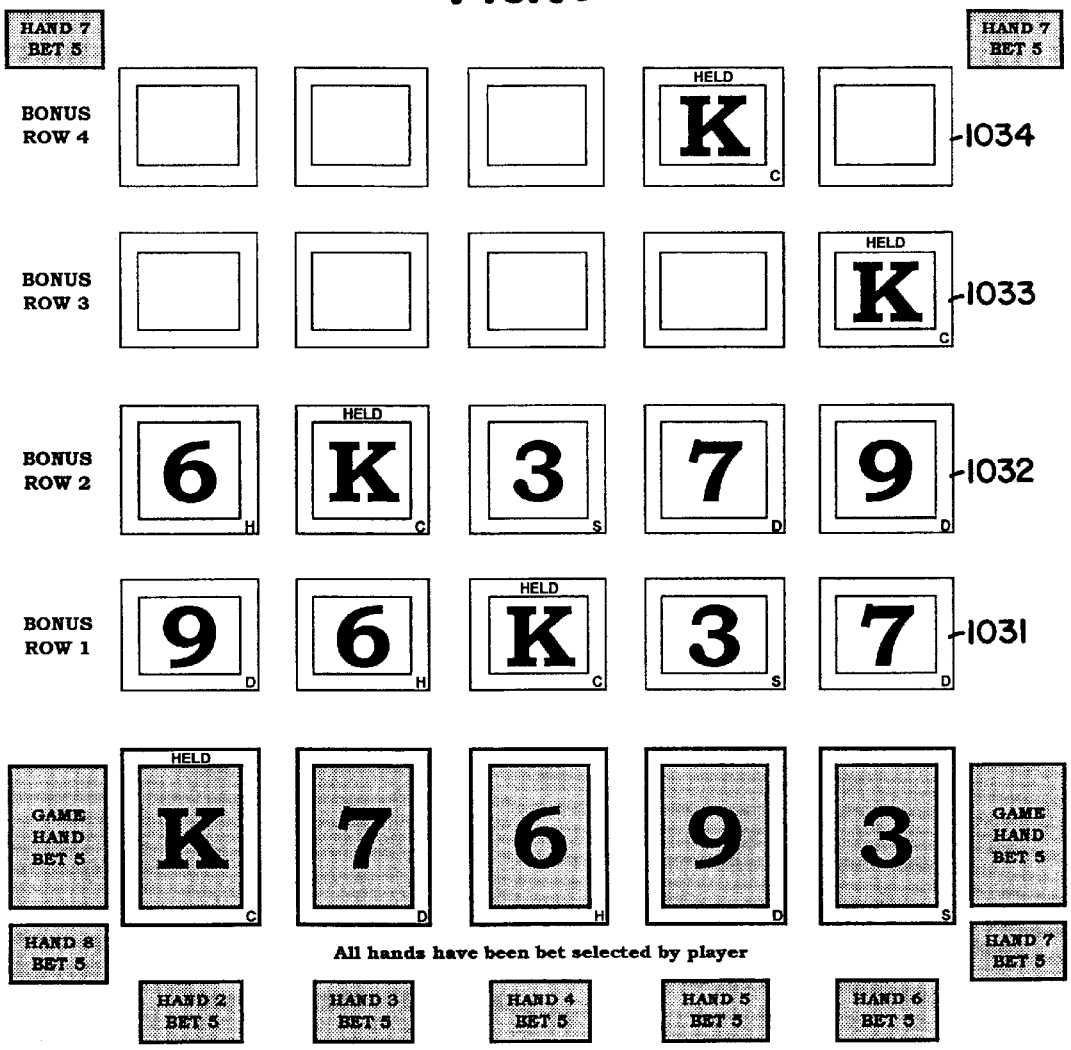
Figure 10G:
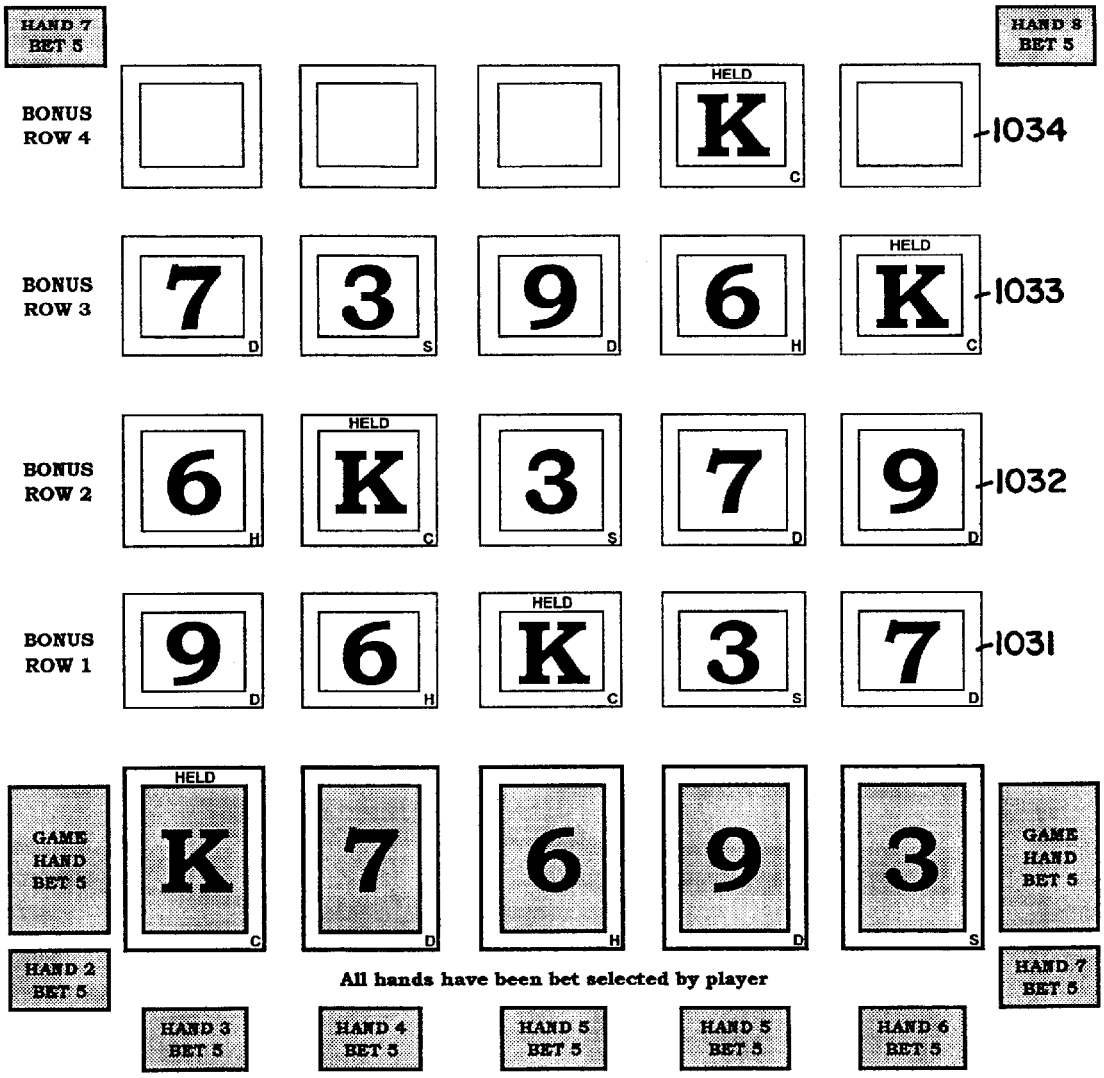
Figure 10H:
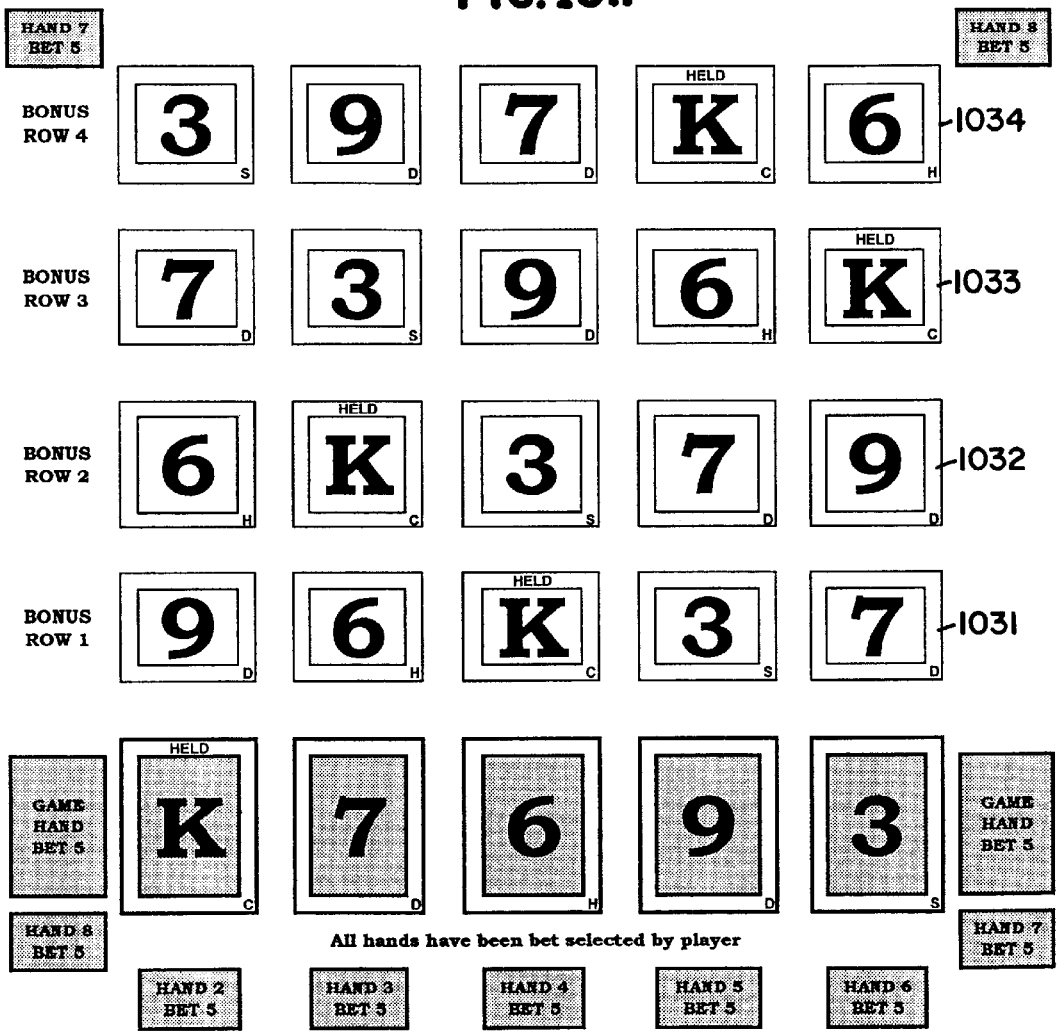

FIGS. 10*e–h* illustrates the filling of the game array, The locations of the discarded cards are filled with cards randomly drawn from the deck with a "7" 1021, a "6" 1022, a "9" 1023, and a "3" 1024. FIG. 10*e* shows the filling of bonus line 1 1031 with these drawn cards. FIG. 10*f* shows the filling of bonus line 2 1032 with these drawn cards. FIG. 10*g* shows the filling of bonus line 3 1033 with these drawn cards. FIG. 10*h* shows the filling of bonus line 4 1034 with these drawn cards.

Figure 10I:
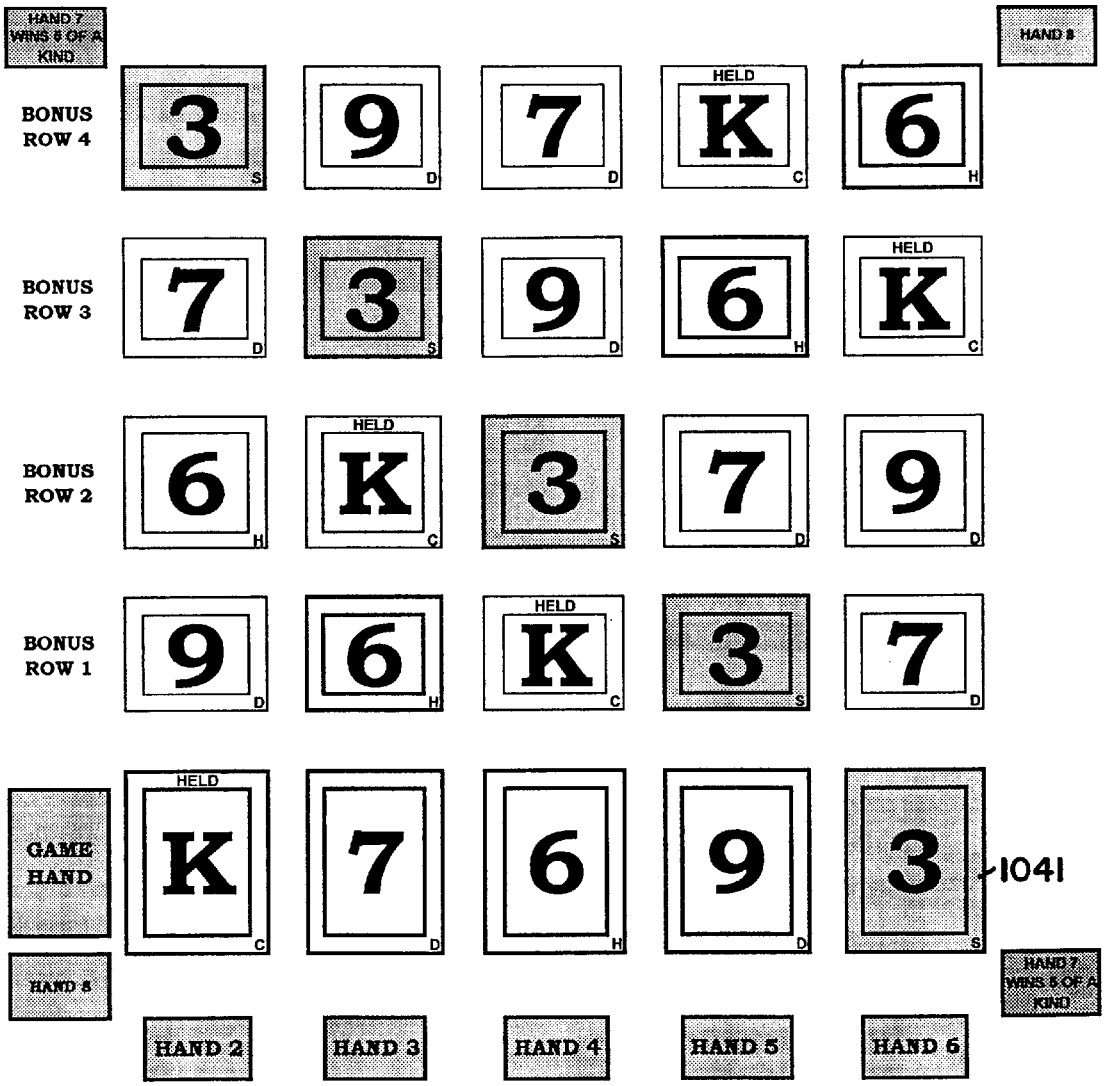
Figure 10J:
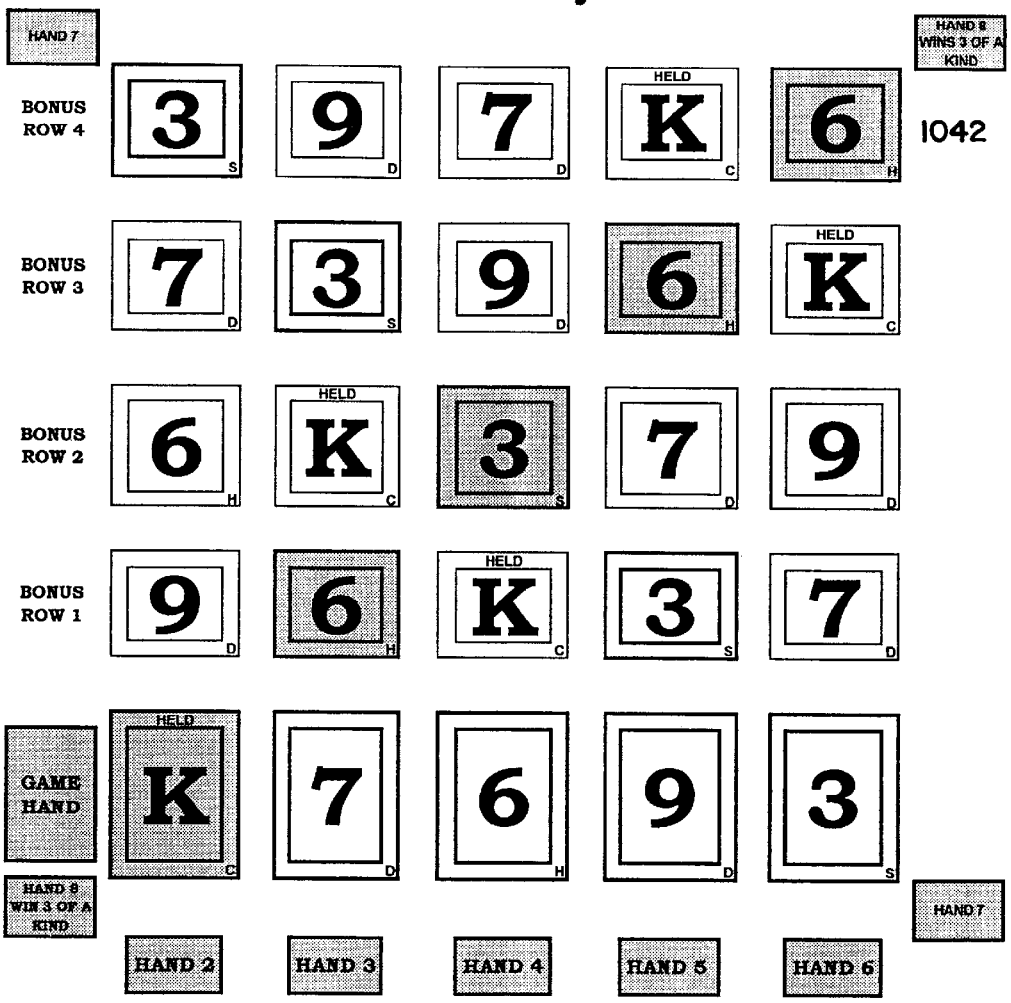

The game concludes with the game checking the game hand for a winning combination in the game hand 1001 and all other paylines. Winning combinations are only found within the two diagonal paylines 1041 and 1042 as shown in FIGS. 10*i* and 10*j*. The total winnings from the awards corresponding to the winning combinations are returned to the player.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A method of playing a multi-line poker game of cards having a game hand line and a plurality of bonus lines that are combined to create a game array having a plurality of paylines on a computer-based video gaming device, the method comprising:

determining a set of game parameters from a set of input signals from a player;

randomly dealing a plurality of cards from a deck of cards to fill the game hand line;

determining the cards from the within the game hand that are to be held and the cards that are to be discarded;

randomly dealing cards from the deck of cards to replace all of the cards discarded from within the game hand;

duplicating each card within the game hand and randomly placing the duplicated cards within the plurality of bonus lines until all of the locations within the game array are filled with cards;

determining whether any of the paylines contain winning combinations of poker hands; and determining an award amount for all winning combinations found within paylines based upon the winning combination, the identity of the payline, and the amount of any wager placed on the payline containing the winning combination;

wherein the paylines comprise the game hand and the plurality of bonus lines.

2. The method according to claim 1, wherein the game array comprises a 3×5 cell array having a row of five locations corresponding to the game hand and two rows of five locations corresponding to the plurality of bonus lines.

3. The method according to claim 2, wherein the game array comprises 5 paylines, the paylines comprise the game hand, the first and second bonus lines, a "V" shaped paylines using cards located within the game array at (1,1), (2,2), (3,3), (2,4), and (1,5), and an inverter "V" shaped payline using cards located within the game array at (3,1), (2,2), (3,3), (2,4), and (3,5).

4. The method according to claim 1, wherein the game array comprises a 5×5 cell array having a row of five locations corresponding to the game hand and four rows of five locations corresponding to the plurality of bonus lines.

5. The method according to claim 4, wherein the game array comprises 3 paylines, the paylines comprise the game hand and the first and second bonus lines.

6. The method according to claim 4, wherein the game array comprises 5 paylines, the paylines comprise the game hand, the first and second bonus lines, a "V" shaped paylines using cards located within the game array at (1,1), (2,2), (3,3), (2,4), and (1,5), and an inverter "V" shaped payline using cards located within the game array at (5,1), (4,2), (3,3), (4,4), and (5,5).

7. The method according to claim 1, wherein the game array comprises 3 paylines, the paylines comprise the game hand and the first and second bonus lines.

8. The method according to claim 1, wherein the set of game parameters comprise the number of rows in the game array, the number of paylines to be played, the amount wagered on each payline being played and the position of the game hand within the game array.

9. The method according to claim 1, wherein the play discards between 1 and 5 cards from the game hand after the game hand is filled the first time.

10. The method according to claim 1 wherein the winning combinations comprise 5 of a kind, a royal straight flush, a straight flush, four of a kind, a full house, a flush, a straight, 3 of a kind, two pair, pair of jacks or better.

* * * * *